US006726299B2

(12) United States Patent
Takahashi et al.

(10) Patent No.: US 6,726,299 B2
(45) Date of Patent: Apr. 27, 2004

(54) INK JET RECORDING APPARATUS, METHOD OF CONTROLLING THE APPARATUS, AND RECORDING MEDIUM HAVING THE METHOD RECORDED THEREON

(75) Inventors: Tomoaki Takahashi, Nagano (JP); Noboru Tamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/768,811

(22) Filed: Jan. 25, 2001

(65) Prior Publication Data

US 2001/0022595 A1 Sep. 20, 2001

(30) Foreign Application Priority Data

Jan. 25, 2000 (JP) ..... P. 2000-016176
Jan. 25, 2000 (JP) ..... P. 2000-016177

(51) Int. Cl.[7] ..... B41J 29/38
(52) U.S. Cl. ..... 347/11
(58) Field of Search ..... 347/15, 11, 10; 358/298

(56) References Cited

U.S. PATENT DOCUMENTS 5,198,833 A * 3/1993 Kubota ..... 347/15
5,480,240 A 1/1996 Bolash et al. ..... 400/124.01
5,600,351 A * 2/1997 Holstun et al. ..... 347/15
5,610,637 A * 3/1997 Sekiya et al. ..... 347/15
5,923,345 A 7/1999 Imai ..... 347/11
5,943,068 A * 8/1999 Ono et al. ..... 358/298
5,975,672 A * 11/1999 Wen ..... 347/15
6,257,688 B1 * 7/2001 Kubo ..... 347/11
6,419,336 B1 * 7/2002 Takahashi ..... 347/15

FOREIGN PATENT DOCUMENTS

| | | | |
|---|---|---|---|
| EP | 0 799 708 A1 | 10/1997 | ..... B41J/2/505 |
| EP | 0 803 367 A2 | 10/1997 | ..... B41J/2/205 |
| EP | 0 827 838 A2 | 3/1998 | ..... B41J/2/21 |
| EP | 0 869 658 A2 | 10/1998 | ..... H04N/1/04 |
| JP | 7-276672 | 10/1995 | |
| JP | 9-46524 | 2/1997 | |
| JP | 10-24567 A | 1/1998 | |
| JP | 10-81013 | 3/1998 | ..... B41J/2/045 |
| JP | 10-193587 A | 7/1998 | |
| JP | 10-202855 A | 8/1998 | |
| JP | 10-211721 | 8/1998 | |
| WO | 99/22942 | 5/1999 | ..... B41J/2/51 |
| WO | 99/52712 | 10/1999 | ..... B41J/2/205 |

* cited by examiner

*Primary Examiner*—Stephen D. Meier
*Assistant Examiner*—Julian D. Huffman
(74) *Attorney, Agent, or Firm*—Sughrue Mion, PLLC

(57) ABSTRACT

An ink jet recording apparatus is operated under a basic recording mode for recording through use of a basic unit pixel which is associated with a unit recording area corresponding to a unit print cycle, and a high-resolution recording mode for recording through use of a fine unit pixel, a plurality of fine unit pixels being arranged within the unit recording area in a main scanning direction of the recording head. The print data is developed into the jetting data such that each bit therein indicates whether the recording is conducted or not in each associated fine unit pixel, when the high-resolution recording mode is selected.

31 Claims, 11 Drawing Sheets

INK JET RECORDING APPARATUS, METHOD OF CONTROLLING THE APPARATUS, AND RECORDING MEDIUM HAVING THE METHOD RECORDED THEREON

BACKGROUND OF THE INVENTION

The present invention relates to an ink jet recording apparatus, and more particularly, to an ink jet recording apparatus capable of switching between different levels of resolution in a main scanning direction and having a simple configuration.

In a related ink jet recording apparatus, a recording head is moved in the main scanning direction (e.g., the widthwise direction of paper), and ink droplets are jetted from the recording head in synchronism with movement of the recording head. A recording apparatus of this type forms a basic unit pixel by a plurality of ink droplets (e.g. three or four) arranged in the main scanning direction. In this recording apparatus, a drive signal is cyclically and repeatedly generated on a per-print-cycle-basis, wherein a plurality of drive pulses, each pulse having the same waveform pattern, are spaced at constant intervals (meaning that an ink droplet jetted from the actuator as a result of a single waveform being applied to the actuator assumes a substantially constant volume). The drive pulses are arranged in a train and spaced at constant intervals. When a basic unit pixel image is recorded on a recording medium, the drive pulses are selectively supplied to pressure generating elements of the recording head, whereby ink droplets are jetted from the recording head. The recording head employed in the recording apparatus has a row of nozzles formed by arranging a plurality of nozzle orifices in a subscanning direction (e.g., a direction in which paper is to be fed).

In such a recording apparatus, when an attempt is made to perform a recording operation through use of fewer ink droplets required to form an unit pixel, there can be performed a high-resolution recording operation, in which the resolution of an image or character is enhanced with reference to the main scanning direction. In other words, there can be effected switching between a basic mode for effecting recording operation through use of basic unit pixels and a high-resolution mode for effecting recording operation through use of fine unit pixels that are of higher resolution than the basic unit pixels. For instance, in a case where a basic unit pixel to be used in a basic mode consists of four ink droplets, a forward fine unit pixel is formed by combination of the first and second ink droplets, and a rear fine unit pixel is formed by combination of the third and fourth ink droplets. Accordingly, recording can be effected in a high-resolution mode with the level of resolution with respect to the main scanning direction being enhanced to twice that in the basic mode.

However, a recent recording apparatus tends to shorten a single print cycle, in order to improve type speed. Moreover, the number of nozzle orifices constituting the row of nozzles; that is, the number of jetting data sets to be recorded by a single row of nozzles, tends to increase. On one hand, the number of jetting data sets to be recorded within a print cycle increases. On the other hand, setting of the jetting data sets must be performed within a shorter time period. If one dot is recorded in the high-resolution mode; that is, if recording is effected by means of sending data for each fine unit pixel, jetting data must be set within a considerably short time period, thus rendering control of recording operation difficult. Consequently, there must be taken measures to prolong a print cycle within a high-resolution mode or to decrease scanning speed of a carriage, or like measures, thus decreasing the print speed.

SUMMARY OF THE INVENTION

The present invention has been conceived under the circumstances set forth and is aimed at providing an ink jet recording apparatus enabling recording without involvement of a decrease in print speed even in the high-resolution mode.

In order to achieve the above object, according to the present invention, there is provided An ink jet recording apparatus comprising:

- a recording head provided with a pressure generating element;
- a scanning mechanism for moving the recording head in a main scanning direction;
- a data developer for developing print data into jetting data;
- a drive signal generator for generating a drive signal including a plurality of drive pulses, on every unit print cycle;
- a translator for translating the jetting data into pulse select information associated with the respective drive pulses;
- a drive pulse supplier for selectively supplying at least one of the drive pulses to the pressure generating element in accordance with the pulse select information to drive the pressure generating element;
- a basic recording mode for recording through use of a basic unit pixel which is associated with a unit recording area corresponding to the unit print cycle;
- a high-resolution recording mode for recording through use of a fine unit pixel, a plurality of fine unit pixels being arranged within the unit recording area in the main scanning direction; and
- a mode selector for selecting one of plural recording modes including the basic recording mode and the high-resolution recording mode, wherein the data developer develops the print data into the jetting data such that each bit therein indicates whether the recording is conducted or not in each associated fine unit pixel, when the mode selector selects the high-resolution recording mode.

Here, the expression "print data" means data transmitted from a host computer or a like device to the recording apparatus, and the expression "jetting data" means data to be transmitted to the recording head.

Preferably, the data developer develops the print data into the jetting data such that bits therein indicate gradation recorded in the unit recording area, when the mode selector selects the basic recording mode.

Preferably, the translator is provided with waveform select tables associated with the respective recording modes. Each of the waveform select table defines a correspondence between the jetting data and the pulse select information in the associated recording mode. The translator translates the jetting data into the pulse select information with reference to the waveform select table of the recording mode selected by the mode selector. More preferably, the waveform select table is rewritable. In this configuration, rewriting of data suitable for a recording mode can implemented more flexibly.

Preferably, the mode selector selects the recording mode in accordance with the print data. In this configuration, a recording mode suitable for the print data can be set up.

Preferably, the plural drive pulses are of an identical profile. More preferably, the plural drive pulses are spaced at constant intervals within the unit print cycle.

Preferably, an initial trigger for starting the unit print cycle is derived from the scanning mechanism.

Preferably, the jetting data of plurality of bits are parallel-transmitted from the data developer to the recording head.

According to the present invention, there is also provided an ink jet recording apparatus comprising:

a recording head provided with a pressure generating element;

a scanning mechanism for moving the recording head in a main scanning direction;

a drive signal generator for generating a drive signal including a plurality of drive pulses, on every unit print cycle;

a drive pulse supplier for selectively supplying at least one of the drive pulses to the pressure generating element in accordance with print data, to drive the pressure generating element; and a high-resolution recording mode for recording through use of a fine unit pixel, a plurality of fine unit pixels being arranged in the main scanning direction within a unit recording area corresponding to the unit print cycle, wherein the drive pulse supplier divides the drive pulses in the drive signal into a plurality of groups each including a same number of the drive pulses such that the last drive pulse included in a group used for a fine unit pixel to be recorded previously is also included in a group used for a fine unit pixel to be recorded subsequently, and supplies the drive pulses included in at least one of the groups to the pressure generating element.

According to the present invention, there is also provided an ink jet recording apparatus comprising:

a recording head provided with a pressure generating element;

a scanning mechanism for moving the recording head in a main scanning direction;

a drive signal generator for generating a drive signal including a plurality of drive pulses, on every unit print cycle;

a drive pulse supplier for selectively supplying at least one of the drive pulses to the pressure generating element in accordance with print data, to drive the pressure generating element; and a high-resolution recording mode for recording through use of a fine unit pixel, a plurality of fine unit pixels being arranged in the main scanning direction within a unit recording area corresponding to the unit print cycle, wherein the drive pulse supplier divides the drive pulses in the drive signal into a plurality of groups each including a same number of the drive pulses such that at least one drive pulse is interposed between a group used for a fine unit pixel to be recorded previously and a group used for a fine unit pixel to be recorded subsequently, and supplies the drive pulses included in at least one of the groups to the pressure generating element; and wherein the drive pulse supplier also supplies the interposed drive pulse to the pressure generating element when both of the groups used for the previous fine unit pixel and the subsequent fine unit pixel.

According to the present invention, there is also provided an ink jet recording apparatus comprising:

a recording head provided with a pressure generating element;

a scanning mechanism for moving the recording head in a main scanning direction;

a drive signal generator for generating a drive signal including a plurality of drive pulses, on every unit print cycle;

a drive pulse supplier for selectively supplying at least one of the drive pulses to the pressure generating element in accordance with print data, to drive the pressure generating element; and a high-resolution recording mode for recording through use of a fine unit pixel, a plurality of fine unit pixels being arranged in the main scanning direction within a unit recording area corresponding to the unit print cycle, the high-resolution recording mode including:

a first high-resolution recording mode in which the drive pulse supplier divides the drive pulses in the drive signal into a plurality of groups each including a same number of the drive pulses such that the last drive pulse included in a group used for a fine unit pixel to be recorded previously is also included in a group used for a fine unit pixel to be recorded subsequently; and supplies the drive pulses included in at least one of the groups to the pressure generating element; and a second high-resolution recording mode in which the drive pulse supplier divides the drive pulses in the drive signal into a plurality of groups each including a same number of the drive pulses such that at least one drive pulse is interposed between a group used for a fine unit pixel to be recorded previously and a group used for a fine unit pixel to be recorded subsequently, and supplies the drive pulses included in at least one of the groups to the pressure generating element, and the drive pulse supplier also supplies the interposed drive pulse to the pressure generating element when both of the groups used for the previous fine unit pixel and the subsequent fine unit pixel; and mode selector for selecting one of a plurality of recording modes including the first high-resolution recording mode and the second high-resolution recording mode.

In the above configurations, preferably, the ink jet recording apparatus further comprises a basic recording mode for recording through use of a basic unit pixel which is associated with the unit recording area.

More preferably, the print data includes gradation information. The drive pulse supplier changes the number of drive pulse to be supplied to the pressure generating element in accordance with the gradation information under the basic recording mode.

According to the present invention, there is also provided An ink jet recording apparatus comprising:

a recording head provided with a pressure generating element;

a scanning mechanism for moving the recording head in a main scanning direction;

a data developer for developing print data into jetting data;

a drive signal generator for generating a drive signal including a plurality of drive pulses, on every unit print cycle;

a translator for translating the jetting data into pulse select information associated with the respective drive pulses;

a drive pulse supplier for selectively supplying at least one of the drive pulses to the pressure generating element in accordance with the pulse select information to drive the pressure generating element;

a basic recording mode for recording through use of a basic unit pixel which is associated with a unit recording area corresponding to the unit print cycle;

a high-resolution recording mode for recording through use of a fine unit pixel, a plurality of fine unit pixels being arranged within the unit recording area in the main scanning direction; and a mode selector for selecting one of plural recording modes including the basic recording mode and the high-resolution recording mode, wherein the number of gradation level can be recorded in the basic recording mode is larger than the number of gradation level can be recorded in the high-resolution recording mode.

According to the present invention, there is provided a control method comprising the steps of:

providing an ink jet recording apparatus comprising:

a recording head provided with a pressure generating element;

a scanning mechanism for moving the recording head in a main scanning direction;

a basic recording mode for recording through use of a basic unit pixel which is associated with a unit recording area corresponding to a unit print cycle; and a high-resolution recording mode for recording through use of a fine unit pixel, a plurality of fine unit pixels being arranged within the unit recording area in the main scanning direction;

transmitting print data to the recording apparatus;

selecting one of plural recording modes including the basic recording mode and the high-resolution recording mode, in accordance with the print data;

developing the print data inputted into jetting data;

generating a drive signal including a plurality of drive pulses, on every unit print cycle;

translating the jetting data into pulse select information associated with the respective drive pulses;

supplying selectively at least one of the drive pulses to the pressure generating element in accordance with the pulse select information to drive the pressure generating element, wherein the print data is developed into the jetting data such that each bit therein indicates whether the recording is conducted or not in each associated fine unit pixel, when the high-resolution recording mode is selected.

According to the present invention, there is also provided a computer-readable recording medium for storing program a program to control an ink jet recording apparatus comprising:

a recording head provided with a pressure generating element;

a scanning mechanism for moving the recording head in a main scanning direction;

a basic recording mode for recording through use of a basic unit pixel which is associated with a unit recording area corresponding to a unit print cycle; and a high-resolution recording mode for recording through use of a fine unit pixel, a plurality of fine unit pixels being arranged within the unit recording area in the main scanning direction, the program executing the steps of:

receiving print data;

selecting one of plural recording modes including the basic recording mode and the high-resolution recording mode in accordance with the print data;

developing print data into jetting data;

generating a drive signal including a plurality of drive pulses, on every unit print cycle;

translating the jetting data into pulse select information associated with the respective drive pulses;

supplying selectively at least one of the drive pulses to the pressure generating element in accordance with the pulse select information to drive the pressure generating element, wherein the print data is developed into the jetting data such that each bit therein indicates whether the recording is conducted or not in each associated fine unit pixel, when the high-resolution recording mode is selected.

Here, the term "recording medium" means a single medium which can be perceived as not only a substance such as a floppy disk, but also a network transmitting various signals. Here, no particular limitations are imposed on the form of data transfer.

The controller or constituent elements of the controller can be realized by a computer system.

DETAILED DESCRIPTION OF THE PREFERRED EMBODIMENTS

Modes for implementing the present invention will be described hereinbelow with reference to the drawings.

Figure 1:
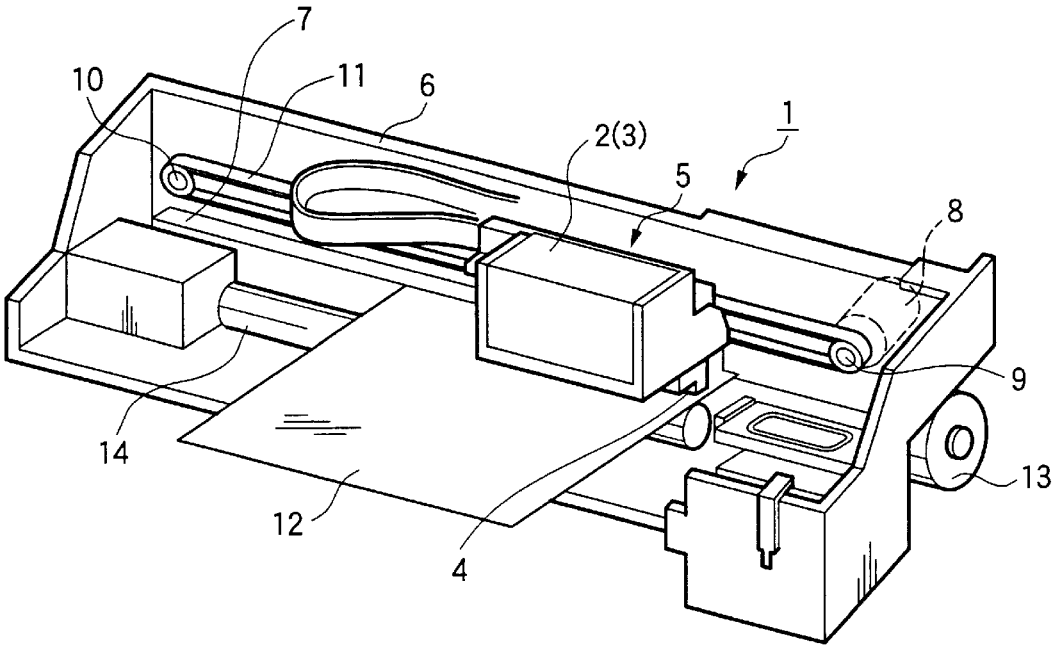
FIG. 1 is a perspective view showing an ink jet printer.

FIG. 1 is a perspective view showing an ink jet printer, which is a typical ink jet recording apparatus.

An illustrated ink jet printer 1 (hereinafter called "printer 1") is equipped with an ink cartridge holder section 3 capable of holding an ink cartridge 2; and a carriage 5 having a recording head 4 mounted thereon. The carriage 5 is movably attached to a guide member 7 provided so as to extend across a housing 6. The carriage 5 is moved back and forth along the guide member 7 by means of a head scanning mechanism.

The head scanning mechanism is constituted of a pulse motor 8 provided on either the right-side or left-side end of the housing 6; a driving pulley 9 connected to a rotary axis of the pulse motor 8; a free-rotating pulley 10 provided on the side of the housing 6 opposite that on which pulse motor 8 provided; a timing belt 11 which extends between the driving pulley 9 and the free-rotating pulley 10 and is connected to the carriage 5; and a control section 46 (see FIG. 3) for controlling rotation of the pulse motor 8. By means of activating the pulse motor 8, the head scanning mechanism reciprocately moves the recording head 4 in the widthwise direction of recording paper 12 (i.e., in the main scanning direction). The recording paper 12 being one type of print recording medium. The printer 1 is further equipped with a paper feed mechanism for feeding the recording paper 12 in the subscanning direction orthogonal to the main scanning direction. This paper feed mechanism is constituting of a paper feeding motor 13 and a platen 14. In association with main scanning action of the recording head 4, the recording paper 12 is fed sequentially.

Figure 2:
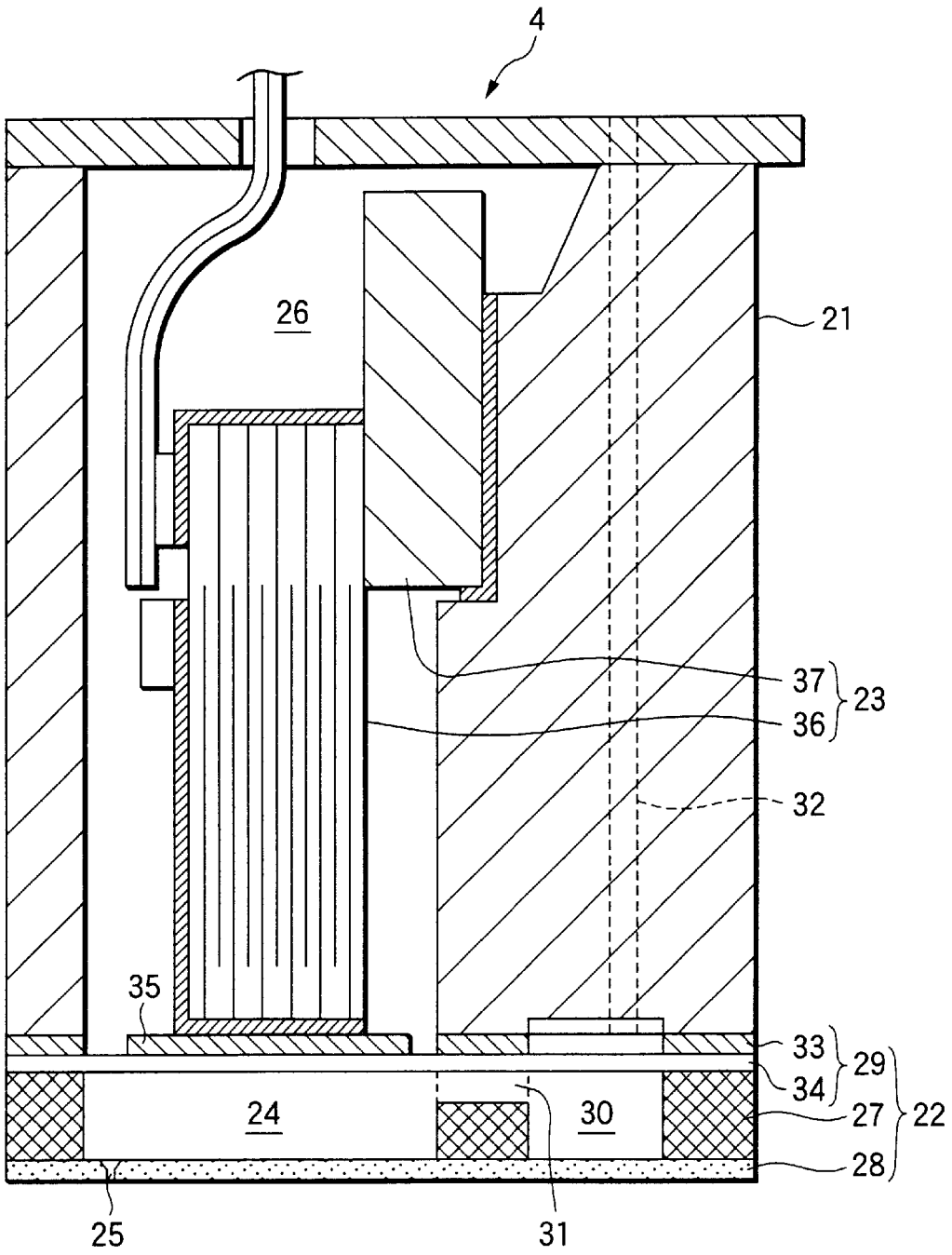
FIG. 2 is a cross-sectional view for describing the internal configuration of a recording head.

The recording head 4 is mounted on the surface (i.e., underside) of the carriage 5 opposite the recording paper 12. As shown in FIG. 2, a channel unit 22 is joined to the end face of a box-shaped casing 21. A vibrator unit 23 housed in the casing 21 induces variations in a pressure chamber 24 provided in the channel unit 22, whereby ink droplets are jetted from nozzle orifices 25.

A housing chamber 26 for housing the vibrator unit 23 is provided within the casing 21. The casing 21 is molded from, for example, resin. The housing chamber 26 extends from an opening of the casing 21 to the other side thereof, and the casing 21 is joined to the channel unit 22.

The channel unit 22 is constituted by means of attaching a nozzle plate 28 to one side of a channel formation substrate 27 and a vibrating plate 29.

The channel formation substrate 27 is formed from, for example, a silicon wafer, and is partitioned into a predetermined pattern by means of etching. In the channel formation substrate 27 are formed a plurality of pressure chambers 24 communicating with corresponding nozzle orifices 25; a common ink reservoir 30; and a plurality of ink-supply passages 31 interconnecting the common ink reservoir 30 and the pressure chambers 24, as required. A connection port to be connected to an ink supply tube 32 is formed in the common ink reservoir 30, and the ink stored in the ink cartridge 2 is supplied to the common ink reservoir 30 by way of the ink supply tube 32.

A plurality of nozzle orifices 25 are formed in the nozzle plate 28 in rows at a pitch corresponding to a dot formation density.

The vibrating plate 29 is of double structure and is formed by means of stacking an elastic film 34, such as a PPS film, on a stainless plate 33. Each of the areas of the stainless plate 33 corresponding to the pressure chambers 24 is etched annularly such that an island section 35 is formed within each annular depression.

The vibrator unit 23 is constituted of piezoelectric vibrators 36, which are one type of pressure generating elements, and a mount member 37 on which the piezoelectric vibrators 36 are to be mounted. The piezoelectric vibrators 36 are formed into a comb-like shape, by means of forming slits in a single piezoelectric vibrator plate, which plate is made by alternately stacking a piezoelectric element and electrode layers, at predetermined pitches corresponding to the respective pressure chambers 24 of the channel unit 22. The base ends of the comb-shaped piezoelectric vibrators 36 are fixed to the mount member 37. The vibrator unit 23 is inserted into the housing chamber 26 of the casing 21 such that the tip ends of the piezoelectric vibrators 36 face the opening of the casing 21. The mount member 37 is fixed to the interior wall of the housing chamber 26, whereby the vibrator unit 23 is finally housed. In this state, the tip ends of the piezoelectric vibrators 36 are brought into contact with and connected to the corresponding island sections 35 of the vibrating plate 29.

By means of applying a potential difference between mutually-opposing electrodes of each of the piezoelectric vibrators 36, the piezoelectric vibrator unit 36 expands and contracts in the longitudinal direction thereof orthogonal to the thickness of the multi-layer piezoelectric vibrator plate. Thereby, a corresponding elastic-body film 34 defining the pressure chamber 24 is displaced. In this recording head 4, as the piezoelectric vibrator unit 36 is extended in the longitudinal direction thereof, a corresponding island section 35 is pressed toward the nozzle plate 28, thereby deforming the elastic-body film 34 around the island section 35. Accordingly, the pressure chamber 24 contracts. In association with expansion and contraction of the pressure chamber 24, variations arise in the pressure exerted on the ink filling the pressure chamber 24, and ink droplets are jetted from the nozzle orifices 25 of the channel unit 22.

Figure 3:
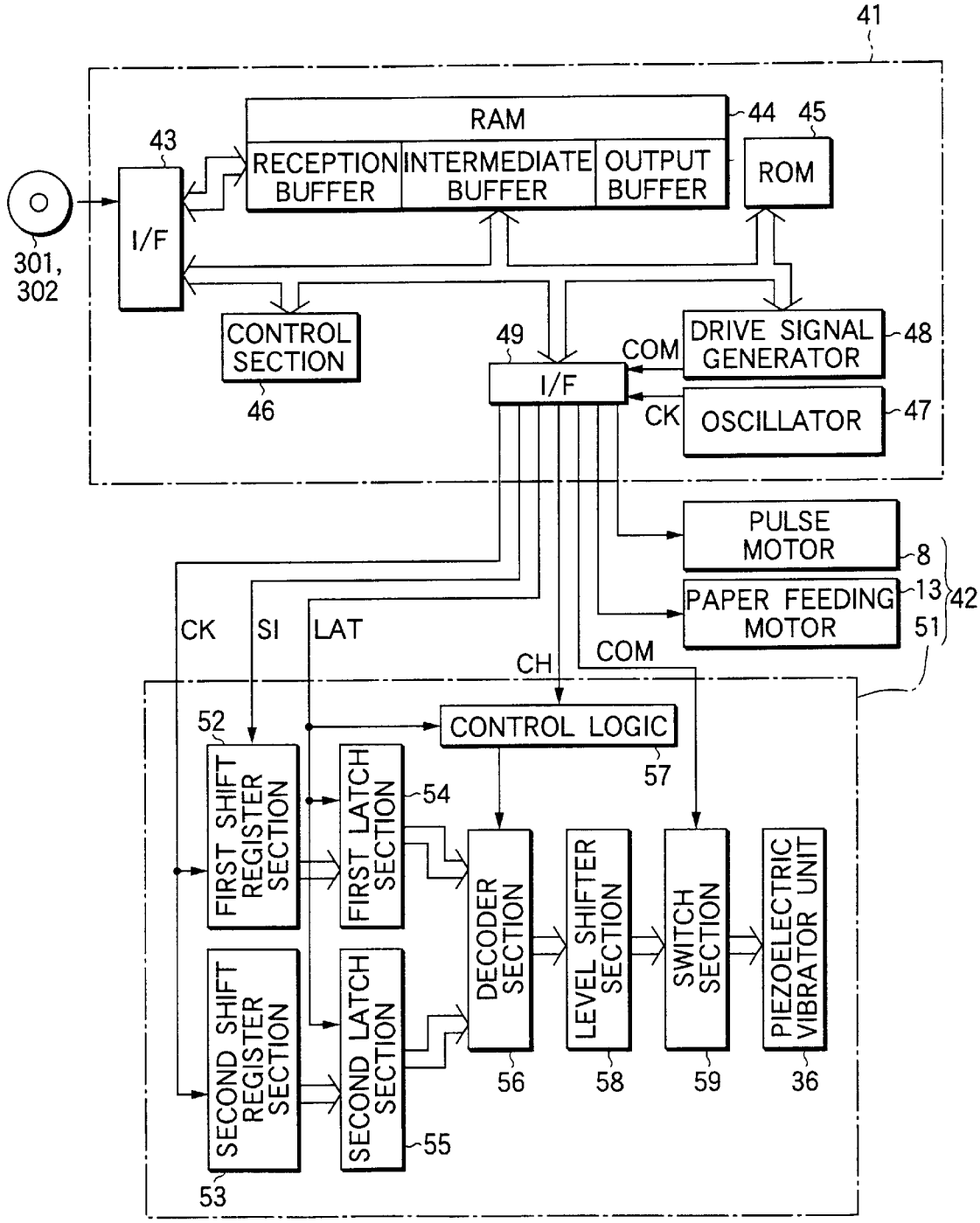
FIG. 3 is a block diagram for describing the electrical configuration of the printer.

Next will be described the electrical configuration of the printer 1. As shown in FIG. 3, the printer 1 is equipped with a printer controller 41 and a print engine 42.

The printer controller 41 comprises an interface 43 (hereinafter called an "external I/F 43") for receiving print data or like data from an unillustrated host computer; RAM 44 for storing various types of data; ROM 45 for storing routines to be used for processing various data sets; a control section 46 formed from a CPU or a like device; an oscillator 47 for generating a clock (CK) signal; a drive signal generator 48 for generating a drive signal (COM) to be supplied to the recording head 4; and an interface 49 (hereinafter called an "internal I/F 49") for transmitting jetting data (S1) and a drive signal to the print engine 42.

The drive signal generator 48 iteratively produces a drive signal on per-print-cycle basis. In the drive signal, drive pulses DP1 to DP4 (see FIG. 5) of identical profile are spaced at given time intervals. In other words, the drive signal generator 48 produces a drive pulse at given intervals. The drive pulse will be described later.

The external I/F 43 receives the print data consisting of any one of a character code, a graphic function, and image data, or a plurality of data sets from the host computer. The external I/F 43 outputs a busy (BUSY) signal or an acknowledge (ACK) signal to the host computer.

The RAM 44 is utilized as a reception buffer, an intermediate buffer, an output buffer, and work memory (not depicted). The print data received by the external I/F 43 from the host computer are temporarily stored in the reception buffer. Intermediate code data which have been converted into an intermediate code by the control section 46 are stored in the intermediate buffer. Print data to be serially transmitted to the recording head 4 are developed in the output buffer. The ROM 45 stores various control routines to be performed by the control section 46, font data, graphic functions, and procedures.

The control section 46 acts as a data developer and develops the print data into jetting data. More specifically, the control section 46 reads the print data from the reception buffer and converts the thus-read jetting data into an intermediate code. The intermediate code is stored in the intermediate buffer. The intermediate code data read from the intermediate buffer are analyzed and developed into bits of jetting data, by reference to the font data or graphic functions stored in the ROM 45. The jetting data described in the present embodiment consist of two bits of data, as will be described later. The thus-developed jetting data are stored in the output buffer. When jetting data corresponding to one-fourth one line of the recording head 4 are produced, the jetting data (S1) for one line are serially transmitted to the recording head 4 by way of the internal I/F 49. When the jetting data for one line are transmitted from the output buffer, the data stored in the intermediate buffer are erased, and the next intermediate code is converted.

The control section 46 also acts as mode selector for selecting one from a plurality of recording modes including a basic mode and a high-resolution mode and sets the thus-selected recording mode. The recording modes employed in the present embodiment are classified into two types of modes; namely, a basic recording mode and a high-resolution recording mode. The control section 46 sets the appropriate one of the recording modes on the basis of the jetting data output from the host computer. A mode selection switch (not depicted) may be provided in the printer 1 such that a recording mode is set by means of inputting a signal output from the selection switch to the control section 46.

Figure 5:
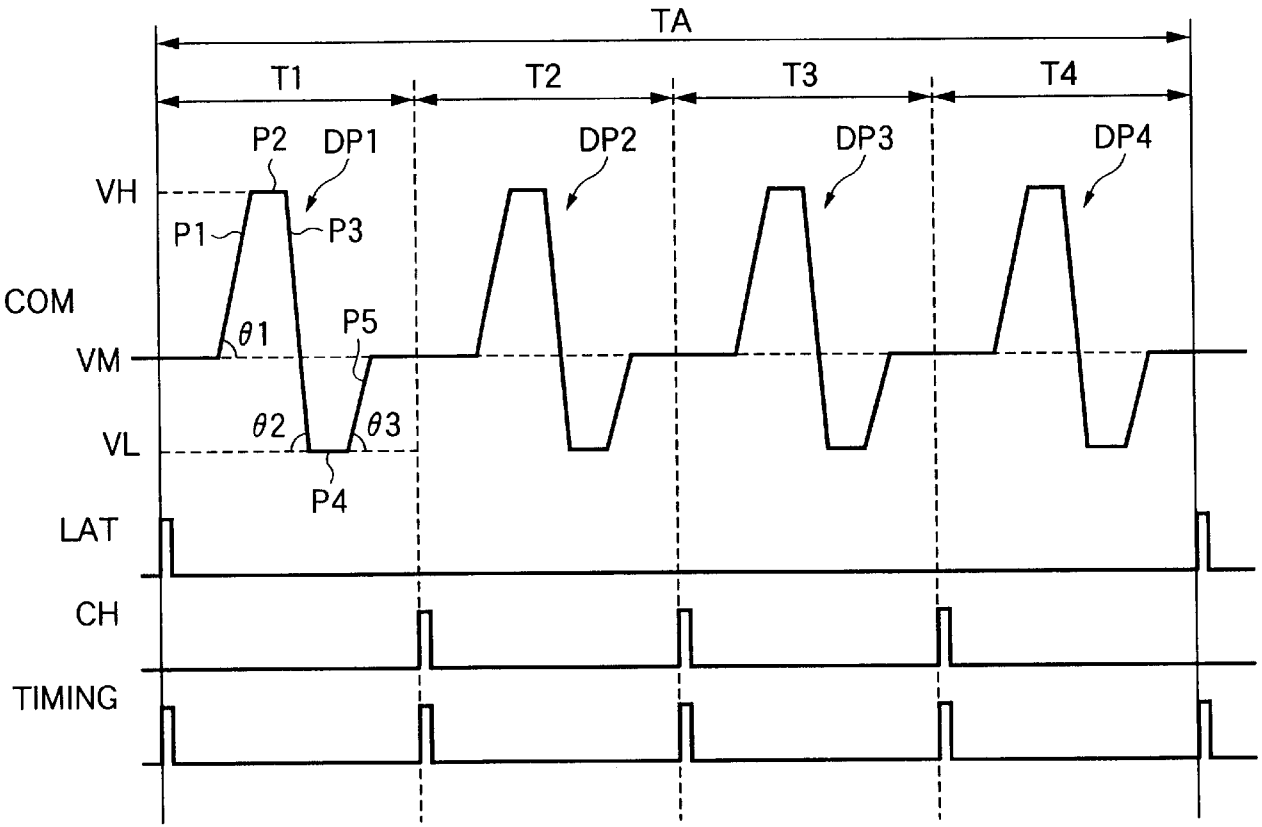
FIG. 5 is a timing chart for describing drive signals and a timing signal according to a first embodiment of the present invention.

The basic mode is one in which a single unit pixel (i.e., a basic unit pixel) can be recorded in a recording area corresponding to one print cycle TA (see FIG. 5). In contrast, the high-resolution mode is one in which a plurality of unit pixels (i.e., fine unit pixels) can be recorded in a recording area corresponding to one print cycle TA in the main scanning direction. In the present embodiment, resolution in the main scanning direction is set to be twice that in the basic mode. In the high-resolution mode, two fine unit pixels can be recorded within a unit pixel formation area used in the basic mode. Here, the expression "one print cycle in the main scanning direction" is usually defined as a time required for the recording head 4 to move a length corresponding the basic unit pixel.

The control section 46 constitutes a part of a timing signal generator and supplies a latch (LAT) signal and a channel (CH) signal to the recording head 4 by way of the internal I/F 49. The latch signal and the channel signal define timings at which supply of drive pulses DP1 to DP4 constituting a drive signal (COM) is commenced.

The print engine 42 is constituted of a drive pulse supplier 51 of the recording head 4, the pulse motor 8 for moving the carriage 5, and the paper feeding motor 13 for rotating the platen 14.

Figure 4:
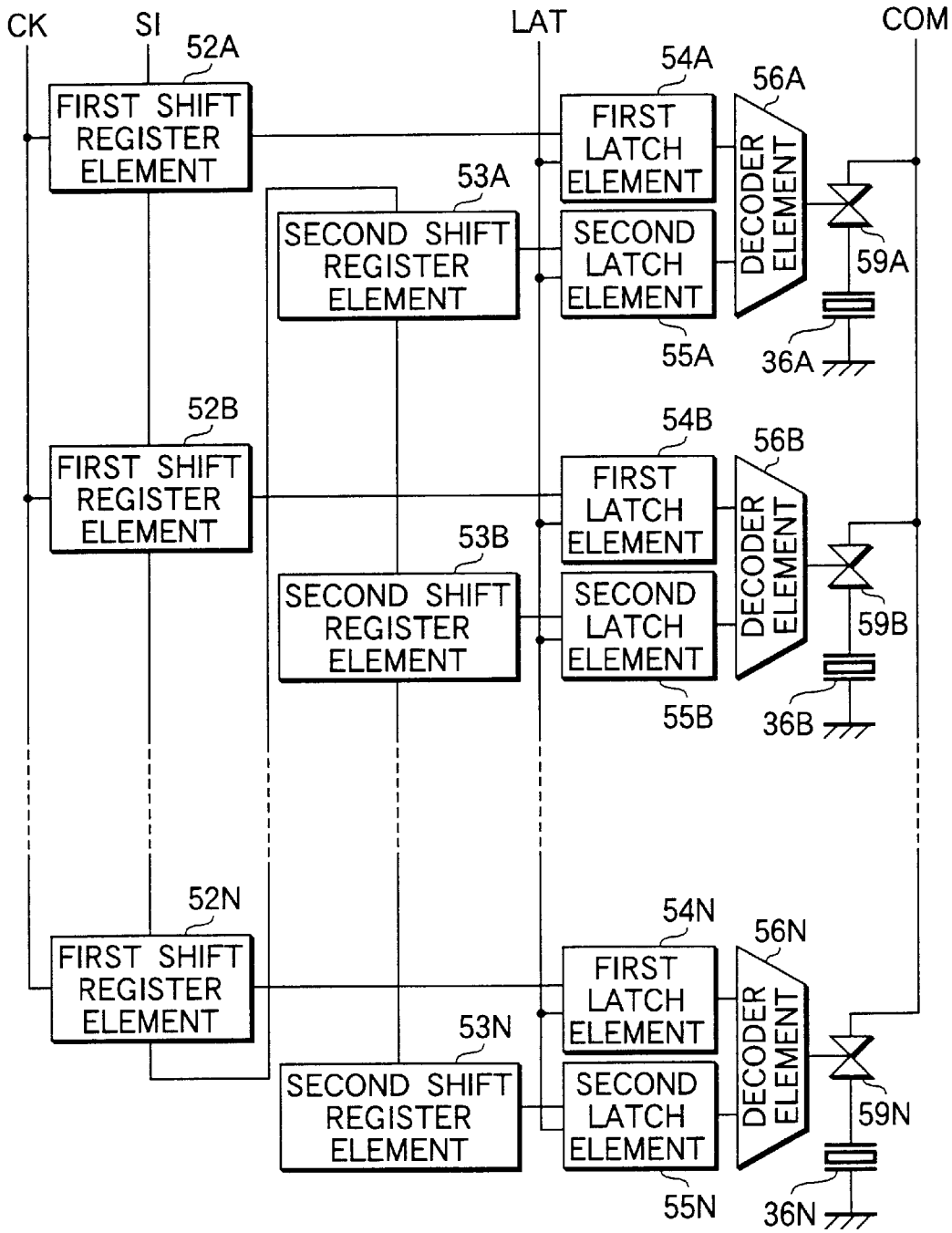
FIG. 4 is a block diagram for describing an electrical drive system of the recording head.

The drive pulse supplier 51 is constituted of a shift register section consisting of a first shift register section 52 and a second shift register section 53; a latch section consisting of a first latch section 54 and a second latch section 55; a decoder section 56; a control logic 57; a level shifter section 58; a switch section 59; and a piezoelectric vibrator unit 36. The first shift register section 52, the second shift register section 53, the first latch section 54, the second latch section 55, the decoder section 56, the switch section 59, and the piezoelectric vibrator unit 36 are provided in number equal to that of nozzle orifices 25 of the recording head 4. As shown in FIG. 4, the drive pulse supplier 51 comprises first register elements 52A through 52N, second shift register elements 53A through 53N, first latch elements 54A through 54N, second latch elements 55A through 55N, decoder elements 56A through 56N, switch elements 59A through 59N, and piezoelectric vibrators 36A through 36N. Although the level shifter elements 58 are omitted from FIG. 4, the level shifter elements 58 are also provided in number equal to that of the nozzle orifices 25.

On the basis of the jetting data output from the printer controller 41, the recording head 4 jets ink droplets. The jetting data (S1) output from the printer controller 41 are serially transmitted from the internal I/F 49 to the first shift register section 52 and the second shift register section 53 in synchronism with the clock (CK) signal output from the oscillator 47. The jetting data correspond to two bits of data. In a basic mode, the jetting data consist of gradation information representing four levels; that is, a non-recording level, a small-dot level, a medium-dot level, and a large-dot level. In the present embodiment, a non-recording level corresponds to gradation information (00); a small-dot level corresponds to gradation information (01); a medium-dot level corresponds to gradation information (10); and a large-dot level corresponds to gradation information (11). In contrast, in a high-resolution recording mode, jetting data consist of print control information representing recording or non-recording of first-half dots (i.e., forward fine unit pixels) and latter-half dots (i.e., rear fine unit pixels) within one print cycle TA. Higher-order bits (H) of the jetting data are assigned to the first-half dots and represent recording or non-recording of the first-half dots. Lower-order bits (L) are assigned to the latter-half bits and represent recording or non-recording of the latter-half bits. For example, the jetting data (00) signify that neither the first-half dots nor the latter-half dots are recorded; jetting data (10) signify recording of only the first-half dots; jetting data (01) signify recording of only the latter-half dots; and jetting data (11) signify continuous recording of first-half dots and latter-half dots. Here, higher-order bits of the jetting data may be assigned to latter-half bits, and lower-order bits of the same may be assigned to first-half bits.

When the basic mode is set, the control section 46, acting as the data developer, develops print data into a plurality of bits of jetting data consisting of gradation information. When the high-resolution mode is set, the control section 46 develops print data into a plurality of bits of jetting data, in which each of the bits represents recording or non-recording of each of fine unit pixels.

Recording of the unit pixels is controlled on the basis of the thus-developed jetting data.

The jetting data are set for each of the nozzle orifices 25. Lower-bit (L) data pertaining to all the nozzle orifices 25 are input to the first shift register section 52 (consisting of the first shift register elements 52A through 52N), and higher-bit (H) data pertaining to all the nozzle orifices 25 are input to the second shift register section 53 (consisting of the second shift register elements 53A through 53N).

The first shift register section 52 is electrically connected to the first latch section 54, and the second shift register section 53 is electrically connected to the second latch section 55. When the latch (LAT) signal output from the printer controller 41 is input to each of the latch sections 54 and 55, the first latch section 54 latches lower-bit data of the jetting data, and the second latch section 55 latches higher-bit data of the jetting data. The first shift register section 52 and the first latch section 54 operating as a pair in such a manner constitute a storage circuit. Similarly, the second shift register section 53 and the second latch section 55 operating as a pair constitute another storage circuit. The jetting data to be input to the decoder section 56 are temporarily stored in either of the two storage circuits.

The jetting data latched by the latch sections 54 and 55 are input to the decoder section 56. The decoder section 56 acts as a translator and translates two bits of jetting data, thereby producing pulse select information. The decoder section 56 described in connection with the present embodiment has a waveform selection table for specifying the relationship between jetting data and one selected from the drive pulses DP1 through DP4. On the basis of the waveform selection table, pulse select information is produced. A plurality of types of waveform selection tables are prepared according to recording modes, and one is selected from the waveform selection tables for each recording mode, as required. The pulse select information is formed from a plurality of bits such that the bits correspond to the respective drive pulses constituting the drive signal (COM). In accordance with the status of each bit [e.g., (0) or (1)], supply/non-supply of drive pulses to the piezoelectric vibrator unit 36 is selected. Control of supply of drive pulses will be described later.

A timing signal output from the control logic 57 is input to the decoder section 56. The control logic 57 acts as a timing signal generator in conjunction with the control section 46. In accordance with a latch (LAT) signal and a channel (CH) signal, the decoder section 56 generates a timing signal. As shown in FIG. 5, a timing signal is generated at the time of receipt of a latch (LAT) signal or a (CH) channel signal. The pulse select information resulting from translation performed by the decoder section 56 is input to the level shifter section 58 in descending order from the highest bit every time timing specified by the timing signal arises. At the first timing (i.e., at the beginning of T1) in the print cycle TA, the highest bit of data pertaining to the pulse select information is input to the level shifter section 58. At the second timing (at the beginning of T2), the second bit of data pertaining to the pulse select information is input to the level shifter section 58. The level shifter section 58 acts as a voltage amplifier. If the pulse select information represents (1), the voltage capable of driving the switch section 59; for example, an electrical signal boosted to several dozen volts, is output. Pulse select information (1) which has been boosted by the level shifter section 58 is supplied to the switch section 59 serving as switching means. A drive signal (COM) output from the drive signal generator 48 is supplied to the input side of the switch section 59, and the piezoelectric vibrator unit 36 is connected to the output side of the switch section 59.

Pulse select information controls operation of the switch section 59; namely, selective supply of the drive pulses DP1 through DP4 to the piezoelectric vibrator unit 36. For instance, during a time period in which the pulse select information applied to the switch section 59 represents (1), the switch section 59 is brought into a connected status, and a drive pulse is supplied to the piezoelectric vibrator unit 36. The potential level of the piezoelectric vibrator unit 36 changes in accordance with the drive pulse. In contrast, during a time period in which the pulse select information applied to the switch section 59 represents (0), the level shifter section 58 does not output any electrical signal for activating the switch section 59. Accordingly, the switch section 59 is brought into a disconnected status, and supply of a drive pulse to the piezoelectric vibrator unit 36 is stopped.

Next will be described a drive (COM) signal generated by the drive signal generator 48. As shown in FIG. 5, the drive signal generator 48 described in connection with the present embodiment produces a train of drive signals, in which four drive pulses DP1 through DP4, of substantially identical profile, are spaced at constant intervals within a print cycle.

The drive signal comprises a first drive pulse DP1 arising in period T1, a second drive pulse DP2 arising in period T2 subsequent to period T1, a third drive pulse DP3 arising in period T3 subsequent to period T2, and a fourth drive pulse DP4 arising in period T4 subsequent to T3. The drive signal is iteratively generated within the print cycle TA. In the drive signal, the first drive pulse DP1, the second drive pulse DP2, the third drive pulse DP3, and the fourth drive pulse DP4 assume identical waveform profiles. When the drive signal is supplied to the piezoelectric vibrator unit 36, a predetermined amount of ink droplets (e.g., 9 pL) is jetted from the corresponding nozzle orifice 25 of the recording head 4.

Each of the drive pulses DP1 through DP4 comprises a charging element P1 during which the potential rises from an intermediate potential VM to the maximum potential VH at gradient θ1; a first holding element P2 during which the maximum potential VH is sustained; a jetting element P3 during which the potential is decreased from the maximum potential VH to the minimum potential VL at gradient θ2 within a very short time period; a second holding element P4 during which the minimum potential VL is sustained; and a damping element P5 during which the potential is raised from the minimum potential VL to the intermediate potential VM at gradient θ3. When the charging element P1 is supplied to the piezoelectric vibrator unit 36, the volume of the pressure chamber 24 expands from an intermediate volume, serving as a reference volume, to the maximum volume. As a result of application of the first holding element P2, the pressure chamber 24 is maintained in an expanded state. By means of supply of the jetting element P3, the pressure chamber 24 abruptly contracts to the minimum volume. The thus-contracted state of the pressure chamber 24 is sustained over a time period during which the second holding element P4 is supplied to the piezoelectric vibrator unit 36. As a result of abrupt contraction of the pressure chamber 24 and the contracted state of the pressure chamber 24 being sustained, the pressure of the ink stored in the pressure chamber 24 abruptly increases, whereby an ink droplet is jetted from the corresponding nozzle orifice 25. Next, the damping element P5 is supplied to the piezoelectric vibrator unit 36, and the pressure chamber 2 is returned and expanded to the intermediate volume so as to dampen within a short time period vibrations arising in a meniscus.

Figure 6:
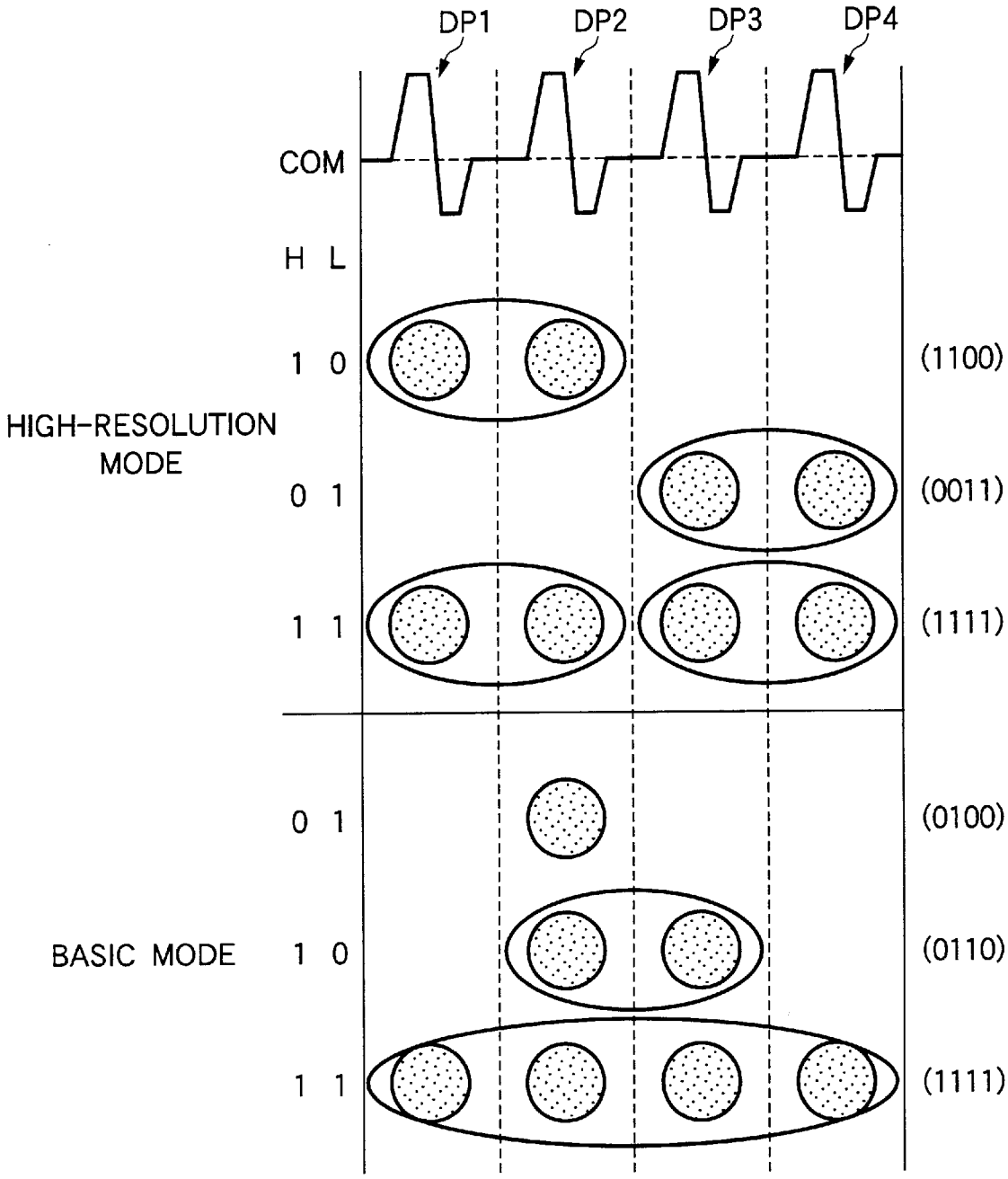
FIG. 6 is an illustration for describing recording control operation according to the first embodiment.

Turning to FIGS. 5 and 6, there will be described control for selectively supplying any of the drive pulses DP1 through DP4 to the piezoelectric vibrator unit 36.

Control in the basic mode will first be described. In this basic mode, a gradation is recorded through use of basic unit pixels. More specifically, in this basic mode, recording is effected through use of dots of different sizes (i.e., basic unit pixels), by means of increasing or decreasing the number of drive pulses to be supplied to the piezoelectric vibrator unit 36. For instance, an ink droplet is jetted one time by supplying a single drive pulse, thus recording a small dot. An ink droplet is jetted twice by supplying two drive pulses, thus recording a medium dot. An ink droplet is jetted four times by supplying four drive pulses, thus recording a large dot.

More specifically, the control section 46 (data developer) develops print data, which consist of two-bit gradation information and are output from the host computer or another section, and serially transmits the thus-developed jetting data to the recording head 4. For example, the control section 46 develops the print data into non-print jetting data (gradation information 00), small-dot jetting data (gradation information 01), medium-dot jetting data (gradation information 10), or large-dot jetting data (gradation information 11). After having been set in the first and second shift register elements 52 and 53 of the recording head 4, the developed jetting data are latched by the first and second latch sections 54 and 55 at timings of latch signals.

The decoders 56 (translator) translate the jetting data latched by the first and second latch sections 54 and 55, thereby producing four bits of pulse select information corresponding to the respective drive pulses DP1 to DP4. More specifically, the decoder section 56 produces pulse select information (0000) by means of translating the non-print jetting data (00); produces pulse select information (0100) by means of translating the small-dot jetting data (01); produces pulse select information (0110) by means of translating the medium-dot jetting data (10); and produces pulse select information (1111) by means of translating the large-dot jetting data (11).

Bits of the pulse select information correspond to the respective drive pulses DP1 to DP4. More specifically, the highest bit of the pulse select information corresponds to the first drive pulse DP1; the second bit of the same corresponds to the second drive pulse DP2; the third bit of the same corresponds to the third drive pulse DP3; and the fourth bit of the same corresponds to the fourth drive pulse DP4. When the highest bit of pulse select information assumes (1), the switch section 59 is brought into a connected state from the beginning of a period T1 at which the first timing signal is to be generated to the beginning of a period T2 at which the second timing signal is to be generated. When the second bit of pulse select information assumes (1), the switch section 59 is brought into a connected state from the beginning of the period T2 to the beginning of a period T3 at which the third timing signal is to be generated. When the third bit of pulse select information assumes (1), the switch section 59 is brought into a connected state from the beginning of the period T3 to the beginning of a period T4 at which the fourth timing signal is to be generated. Similarly, when the last bit of pulse select information assumes (1), the switch section 59 is brought into a connected state from the beginning of the period T4 to the beginning of the period T1 of the next print cycle TA.

On the basis of the small-dot jetting data (01), a corresponding piezoelectric vibrator 36 supplies a second drive pulse DP2. Similarly, the second drive pulse DP2 and the third drive pulse DP3 are supplied on the basis of the medium-dot jetting data (10). The first drive pulses DP1 to DP4 are successively supplied on the basis of the large-dot jetting data (11). Consequently, an ink droplet of 9 pL is jetted one time from the nozzle orifice 25 in response to the small-dot jetting data, thereby recording a small dot in a recording area corresponding to one print cycle TA. An ink droplet of 9 pL is successively jetted twice from the nozzle orifice 25 in response to the medium-dot jetting data, thereby recording in the recording area a medium dot through use of an ink droplet of 18 pL in total. Similarly, an ink droplet of 9 pL is successively jetted four times from a corresponding nozzle orifice 25 in response to large-dot jetting data, and a large dot is recorded in the recording area through use of an ink droplet of 36 pL in total.

Next, control in a high-resolution mode will be described. In a high-resolution mode, recording is effected through use of fine unit pixels. More specifically, in a high-resolution mode, two fine unit pixels can be defined in the main scanning direction within a recording area corresponding to a single print cycle TA. In the present embodiment, a forward fine unit pixel (i.e., a forward dot) is recorded by means of supplying the first drive pulse DP1 and the second drive pulse DP2, and a rear fine unit pixel (i.e., a rear dot) is recorded by means of supplying the third drive pulse DP3 and the fourth drive pulse DP4.

In more detail, the control section 46 (data developer) develops the print data output from the host computer into jetting data consisting of two-bit print control information, and serially transmits the thus-developed jetting data to the recording head 4. For example, the control section 46 develops the print data into non-print jetting data (gradation information 00), small-dot jetting data (gradation information 01), medium-dot jetting data (gradation information 10), or large-dot jetting data (gradation information 11). After having been set in the first and second shift register sections 52 and 53 of the recording head 4, the developed jetting data are latched by the first and second latch sections 54 and 55 at timings of latch signals.

The decoder section 56 (translator) translates the jetting data latched by the first and second latch sections 54 and 55, thereby producing four bits of pulse select information corresponding to the respective drive pulses DP1 to DP4. More specifically, the decoder section 56 produces pulse select information (0000) by means of translating the non-print jetting data; produces pulse select information (1100) by means of translating forward dots of jetting data; produces pulse select information (0011) by means of translating rear dots of jetting data; and produces pulse select information (1111) by means of translating jetting data of forward and rear dots.

Bits of the pulse select information correspond to the respective drive pulses DP1 to DP4. On the basis of the forward dots of jetting data (10), the first drive pulse DP1 and the second drive pulse DP2 are supplied to a corresponding piezoelectric vibrator 36. Similarly, the third drive pulse DP3 and the fourth drive pulse DP4 are supplied on the basis of rear dots of jetting data (01). On the basis of forward and rear dots of jetting data (11), the first drive pulse DP1 through the fourth drive pulse DP4 are successively supplied. Consequently, an ink droplet of 9 pL is jetted twice from the nozzle orifice 25 in the first half of the print cycle TA on the basis of forward dots of jetting data, thereby recording forward dots in the first half of a recording area corresponding to one print cycle TA. An ink droplet of 9 pL is successively jetted twice from the nozzle orifice 25 on the basis of rear dots of jetting data, thereby recording rear dots in the latter half of the recording area corresponding to one print cycle TA. Similarly, an ink droplet of 9 pL is successively jetted four times from a corresponding nozzle orifice 25 in response to forward and rear dots of jetting data. Thus, forward and rear dots are successively recorded in the recording area.

In a high-resolution mode involving the foregoing recording operations, higher-order bits (H bits) of jetting data represent recording/non-recording of forward dots. Lower-order bits (L bits) of jetting data represent recording/non-recording of rear dots. Recording control information pertaining to forward dots and rear dots within one print cycle (i.e., information pertaining to recording/non-recording operation to be effected on a per-dot-basis) is collectively transmitted in the form of jetting data. The only requirement is that jetting data be supplied to the recording head 4 every print cycle. The jetting data required in the high-resolution mode become equal in volume to those required in the basic mode. Hence, the time required for setting jetting data can be equal to that required in the basic mode, and requirements, such as a print cycle and the scanning speed of the recording head 4, can be set to be identical with those required in the basic mode, thereby enabling recording in a high-resolution mode without involvement of an increase in print speed.

The present embodiment is susceptible to various additions or modifications within the scope of the present invention.

In the high-resolution mode according to the present embodiment, resolution in the main scanning direction is set so as to become twice that required in the basic mode. However, the resolution may be set so as to become three times or more that required in the basis mode. For example, the drive pulses to be arranged within one print cycle are set to six (i.e., a basic unit pixel is formed with six ink droplets), and jetting data are formed with three bits. Resolution in the main scanning direction can be set so as to become three times that required in the basis mode. In this case, a forward dot can be recorded by means of supplying the first drive pulse DP1 and the second drive pulse DP2 to the piezoelectric vibrator unit 36. A center dot can be recorded by means of supplying the third drive pulse DP3 and the fourth drive pulse DP4 to the piezoelectric vibrator unit 36. A rear dot can be recorded by means of supplying the fifth drive pulse DP5 and the sixth drive pulse DP6 to the piezoelectric vibrator unit 36. The highest-order bit of jetting data is used as information representing the recording status of a forward dot; the second bit is used as information representing the recording status of a center dot; and the lowest bit is used as information representing the recording status of a rear dot.

The waveform selection table set forth may be configured so as to be rewritable. If the waveform selection table is made rewritable, a combination of jetting data and a drive pulse to be selected can be set comparatively freely, thereby enabling easy configuration of a printer of different specifications. For example, a printer set such that a resolution in a high resolution-mode becomes twice that in a basic mode and a printer set such that a resolution becomes three times that in a basic mode can be manufactured simply.

Figure 11:
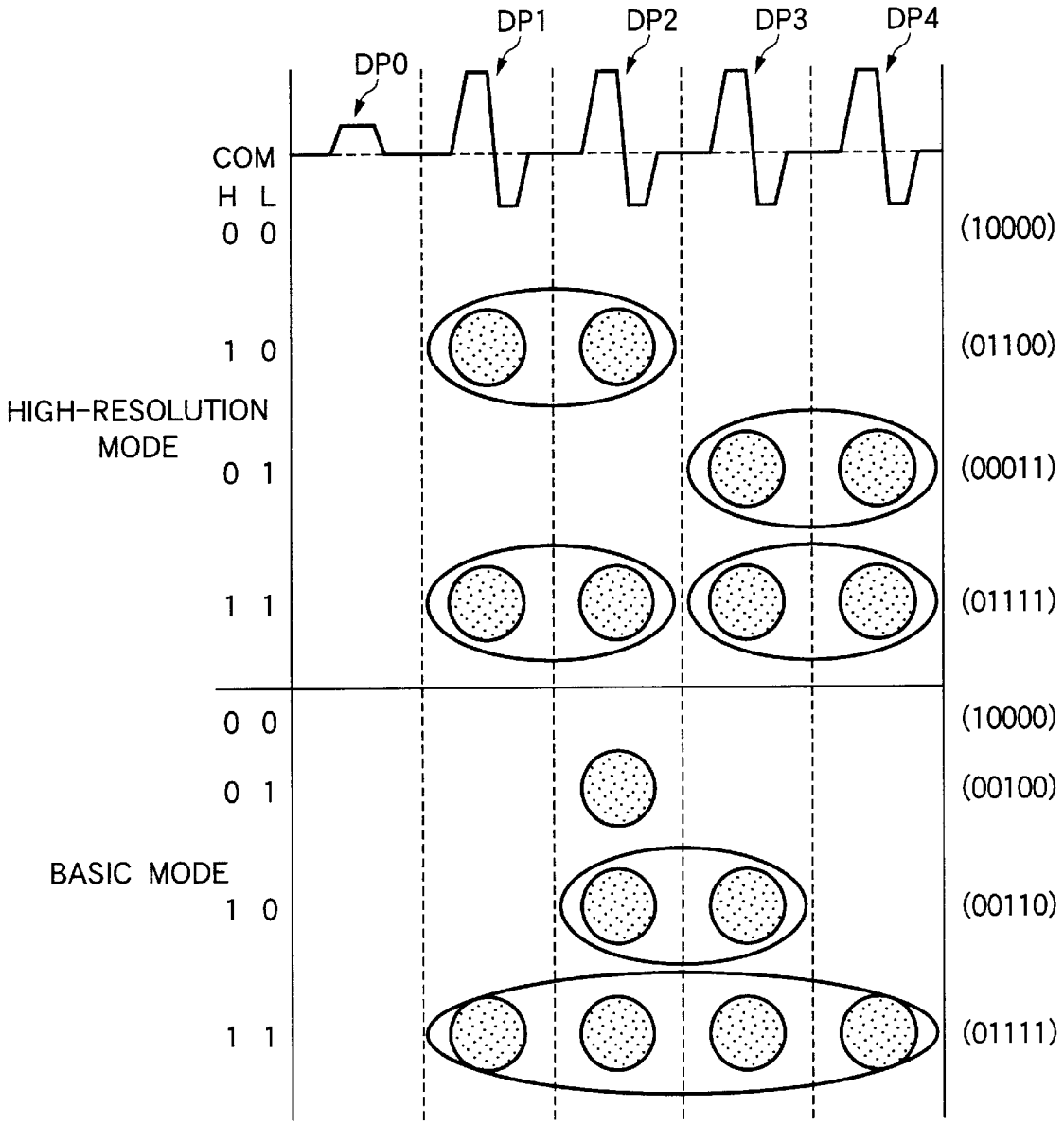
FIG. 11 is an illustration for describing recording control operation according to another embodiment of the present invention.

In this embodiment, although there has been shown an example in which only the drive pulses related to ink jetting is arranged in the drive signal COM, the drive signal may include a vibrating pulse used for preventing ink viscosity in the nozzle at the vicinity of the nozzle orifice. For example, as shown in FIG. 11, there may be arranged in a leading end portion of the drive signal COM, prior to the drive pulses, a vibrating pulse DP0 having an amplitude such an extent that ink is not jetted from the nozzle orifice.

In a case where non-print jetting data (gradation information 00) is provided, the decoder section 56 (translator) translates the jetting data latched by the first and second latch sections 54 and 55, thereby producing five bits of pulse select information corresponding to the respective derive pulses DP0 to DP4. More specifically, the decoder section 56 produces pulse select information (00000) by translating the non-print jetting data, then the drive pulse DP0 is supplied to the piezoelectric vibrator 36.

In this case, it is configured the drive pulse DP0 is not selected when jetting data for jetting ink is supplied. However, it is arbitrary whether the vibrating pulse DP0 is selected. Namely, it may be configured to always select the vibrating pulse DP0 even when jetting data for jetting ink is supplied.

Figure 7:
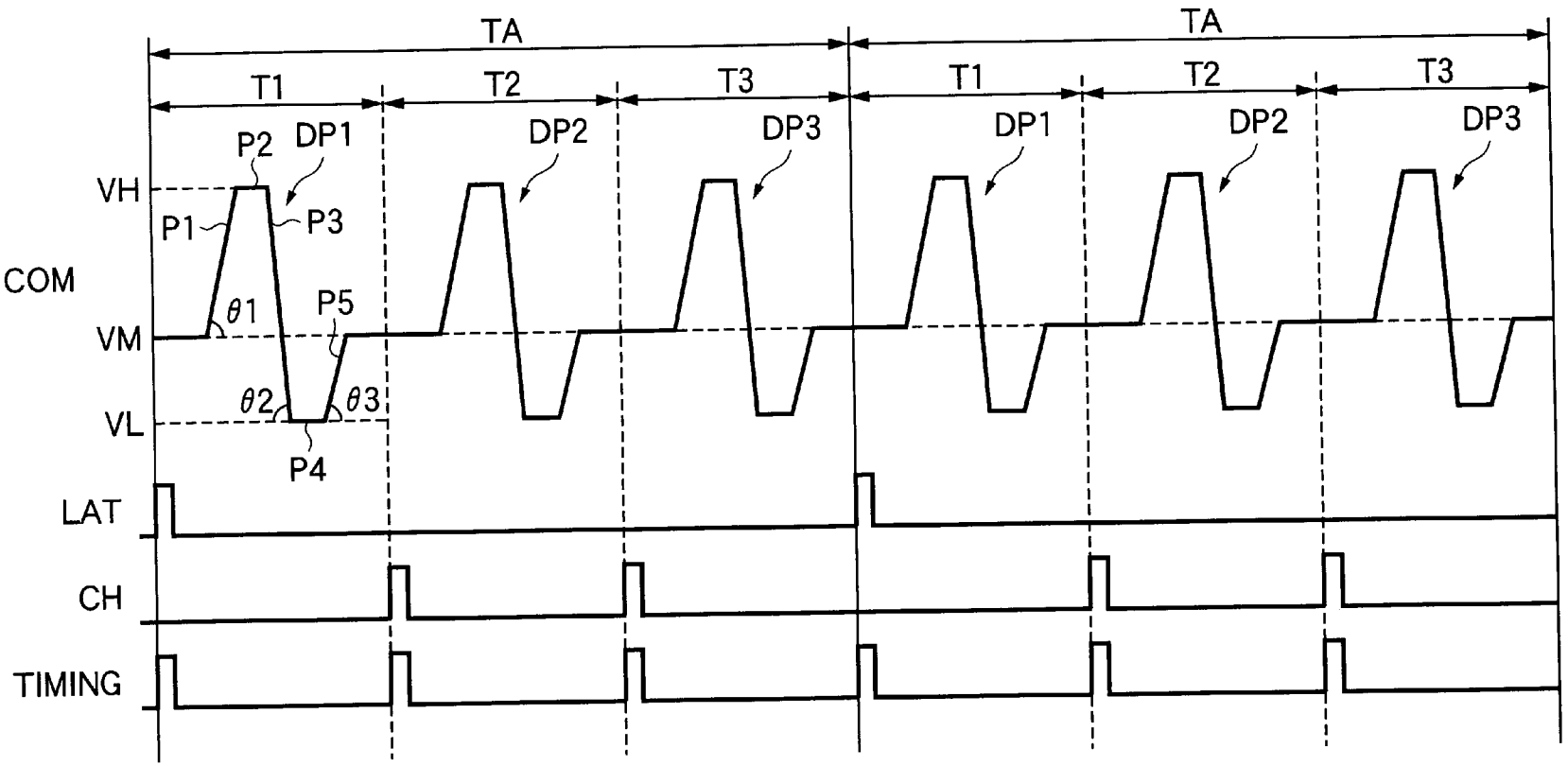
FIG. 7 is a timing chart for describing drive signals and a timing signal according to a second embodiment of the present invention.
Figure 8:
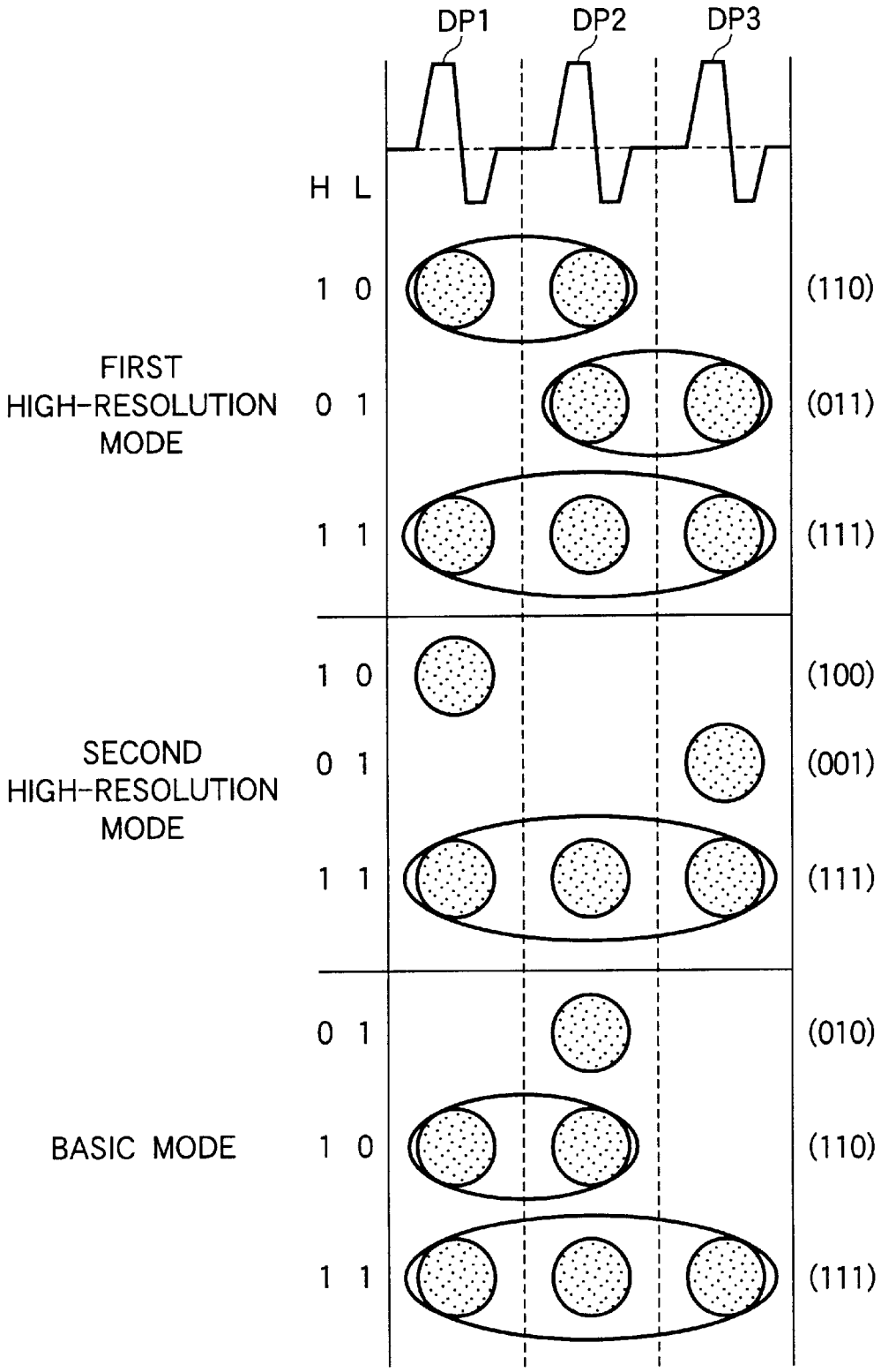
FIG. 8 is an illustration for describing recording control operation according to the second embodiment.

A second embodiment of the present invention will be described by reference to FIGS. 7 and 8. Explanation of overlaps between the first embodiment and the present embodiment is omitted.

Control in a first high-resolution mode will be described. The first high-resolution mode is one in which two fine unit pixels can be defined in the main scanning direction within a recording area corresponding to one print cycle TA. In the first high-resolution mode, the drive pulse supplier 51 divides the drive pulses DP1 through DP3 arising within a single print cycle TA into a plurality of groups, each group having the same number of pulses, such that the final drive pulse in a plurality of drive pulses for a fine unit pixel to be recorded first is also included in drive pulses for a fine unit pixel to be recorded later. More specifically, in the high-resolution mode, the drive pulse supplier 51 divides the three drive pulses DP1 through DP3 constituting a drive signal into a preceding pulse group consisting of the first drive pulse DP1 and the second drive pulse DP2, and a subsequent pulse group consisting of the second drive pulse DP2 and the third drive pulse DP3. In short, the second drive pulse DP2 is included in both the preceding pulse group and the subsequent pulse group.

For example, in a case where resolution in the main scanning direction is made twice that in the basic mode and where a basic unit pixel is constituted of (2n+1) ink droplets, a preceding fine unit pixel is constituted of (n+1) ink droplets. Here, the (n+1)-th ink droplet of the preceding fine unit pixel is also used as the first ink droplet of a subsequent fine unit pixel. Hence, the preceding fine unit pixel is recorded through use of the first through (n+1)-th drive pulses, and the subsequent fine unit pixel is recorded through use of the (n+1)-th drive pulse to the (2n+1)-th drive pulse.

The control section 46 (see FIG. 3) develops print data, thereby producing jetting data for one print cycle TA. In a case where only a preceding fine unit pixel arising within a single print cycle TA is to be recorded, the control section 46 produces jetting data (10). In a case where only a subsequent fine unit pixel is to be recorded, the control section 46 produces jetting data (01). In a case where preceding and subsequent fine unit pixels are to be successively recorded, jetting data (11) are produced.

In the second embodiment, when "n" assumes "1," the decoder section 56 (see FIG. 3) produces pulse select information (110) by means of translating the jetting data (10) to be used for recording only the preceding fine unit pixel. Similarly, the decoder section 56 produces pulse select information (011) by means of translating the jetting data (01) to be used for recording only the subsequent fine unit pixel. The decoder section 56 produces pulse select information (111) by means of translating the jetting data (11) to be used for recording preceding and subsequent fine unit pixels. On the basis of the jetting data (10), the first drive pulse DP1 and the second drive pulse DP2 are supplied to a corresponding piezoelectric vibrator 36. Similarly, on the basis of the jetting data (01), the second drive pulse DP2 and the third drive pulse DP3 are supplied. Further, on the basis of the jetting data (11), the first drive pulses DP1 through DP3 are successively supplied. In a case where preceding and subsequent unit pixels are to be successively recorded, the second drive pulse DP2 is shared between the preceding pulse group and the subsequent pulse group.

Consequently, on the basis of the jetting data (10), an ink droplet is jetted twice in total; i.e., at the beginning and at an intermediate time of a single print cycle TA, whereby a preceding fine unit pixel is recorded in a recording area corresponding to a first-half portion of a single print cycle TA. On the basis of the jetting data (11), an ink droplet is jetted three times in total; i.e., at the beginning, at an intermediate time, and at the end of a single print cycle TA, whereby a fine unit pixel is recorded over the entire recording area corresponding to a single print cycle TA.

As mentioned above, in the first high-resolution mode according to the present embodiment, even if the number of ink droplets corresponding to a basic unit pixel cannot be divided in half, the number of ink droplets constituting fine unit pixels (i.e., the size of a dot) can be made uniform, thereby enabling high-resolution recording with enhanced resolution in the main scanning direction. Since the scanning speed of the recording head 4 and a drive signal COM, which are employed at the time of high-resolution recording, can be made equal to those employed in the basic mode, control can be facilitated.

Next, control in a second high-resolution mode will be described. The second high-resolution mode is one in which two fine unit pixels can be defined in the main scanning direction within an area corresponding to a single print cycle TA. In the second high-resolution mode, the drive pulse supplier 51 divides drive pulses arising within a single print cycle TA into a plurality of pulse groups which correspond to fine unit pixels and are equal in number, such that at least one drive pulse arises between the pulse groups. In a case where a preceding fine unit pixel and a subsequent fine unit pixel are to be successively recorded, a drive pulse arising between the pulse groups is supplied to the piezoelectric vibrator unit 36.

For example, in a case where resolution in the main scanning direction is made twice that in the basic mode and where a basic unit pixel is constituted of (2n+1) ink droplets, a fine unit pixel is constituted of "n" ink droplets. The (n+1)-th ink droplet is provided between the "n" ink droplets constituting the preceding fine unit pixel and the "n" ink droplets constituting the subsequent fine unit pixel. Accordingly, the preceding fine unit pixel is recorded through use of the first through n-th drive pulses, and the subsequent fine unit pixel is recorded through use of the (n+1)-th drive pulse through the (2n+1)-th drive pulse. In a case where the preceding and subsequent fine unit pixels are successively recorded, the (n+1)-th drive pulse is also supplied to the piezoelectric vibrator unit 36.

In the second embodiment, when "n" assumes "1," the drive pulse supplier 51 divides the first drive pulses DP1 through DP3 constituting a drive signal into a preceding pulse group consisting of only the first drive pulse DP1 and a subsequent pulse group consisting of only the third drive pulse DP3. In other words, the second drive pulse DP2 is interposed between the preceding and subsequent pulse groups.

The control section 46 develops print data, thereby producing jetting data for one print cycle TA. Specifically, in a case where only a preceding fine unit pixel arising within a single print cycle TA is to be recorded, the control section 46 produces jetting data (10). In a case where only a subsequent fine unit pixel is to be recorded, the control section 46 produces jetting data (01). In a case where preceding and subsequent fine unit pixels are to be successively recorded, jetting data (11) are produced.

The decoder section 56 produces pulse select information (100) by means of translating the jetting data (10) to be used for recording only the preceding fine unit pixel. Similarly, the decoder section 56 produces pulse select information (001) by means of translating the jetting data (01) to be used for recording only the subsequent fine unit pixel. The decoder section 56 produces pulse select information (111) by means of translating the jetting data (11) to be used for recording preceding and subsequent fine unit pixels. Consequently, on the basis of the jetting data (10), only the first drive pulse DP1 is supplied to a corresponding piezoelectric vibrator 36. Similarly, on the basis of jetting data (01), only the third drive pulse DP3 is supplied. Further, on the basis of the jetting data (11), the first drive pulses DP1 through DP3 are successively supplied. In a case where preceding and subsequent unit pixels are successively recorded, the second drive pulse DP2 interposed between the preceding pulse group and the subsequent pulse group is also supplied to the piezoelectric vibrator unit 36.

Consequently, on the basis of jetting data (10), an ink droplet is jetted one time, at the beginning of one print cycle TA, whereby the preceding fine unit pixel is recorded in a recording area corresponding to the leading portion of the single print cycle TA. Similarly, on the basis of jetting data (01), an ink droplet is jetted one time, at the end of one print cycle TA, whereby the subsequent fine unit pixel is recorded in a recording area corresponding to the leading portion of the single print cycle TA. On the basis of the jetting data (11), an ink droplet is jetted three times in total, at the beginning, at an intermediate time, and at the end of a single print cycle TA, whereby a fine unit pixel is recorded over the entire recording area corresponding to a single print cycle TA.

As mentioned above, in the second high-resolution mode according to the present embodiment, even if the number of ink droplets corresponding to a basic unit pixel cannot be divided in half, the number of ink droplets constituting fine unit pixels can be made uniform, thereby enabling high-resolution recording with enhanced resolution in the main scanning direction. The ink droplets constituting a high-resolution unit image can be made smaller in volume than those required in the first high-resolution mode, thereby enabling recording of a high-grade image of reduced unevenness. In a case where fine unit pixels are to be recorded successively, an ink droplet is jetted by means of the second drive pulse DP2 interposed between the pulse groups, thereby filling a clearance between fine unit pixels, so as to enable appropriate recording with little inconsistency in color. Since the scanning speed and drive waveforms of the recording head 4 employed at the time of high-resolution recording can be made equal to those employed in the basic mode, control can be facilitated.

Next, the operation of the printer 1 will be described. The control section 46 (mode selector) selects and sets one recording mode from among a plurality of recording modes corresponding to print data. Here, one is selected from the basic mode, the first high-resolution mode, and the second high-resolution mode. When a recording mode has been set, the control section 46 outputs control information (i.e., recording mode information) to the decoder section 56. On the basis of the thus-output control information, the decoder section 56 sets a combination of jetting data and pulse select information, by reference to a waveform selection table.

When a recording mode has been set, the printer 1 performs a recording operation in the thus-set recording mode. In the basic mode, the decoder section 56 (translator) handles jetting data (01) as small-dot gradation data, thereby producing pulse select information (010). The decoder section 56 handles jetting data (10) as medium-dot gradation data, thereby producing pulse select information (110). Further, the decoder section 56 handles jetting data (11) as large-dot gradation data, thereby producing pulse select information (111). On the basis of contents of the pulse select information, the switch section 59 supplies a drive pulse to the piezoelectric vibrator unit 36 over periods T1 through T3 corresponding to a case where the pulse select information assumes (1). Consequently, on the basis of jetting data (01), only the second drive pulse DP2 is supplied to the piezoelectric vibrator unit 36, thereby recording a small dot. On the basis of the jetting data (10), the first drive pulse DP1 and the second drive pulse DP2 are supplied to the piezoelectric vibrator unit 36, thereby recording a medium dot. Similarly, on the basis of the jetting data (11), the first drive pulse DP1 through the third drive pulse DP3 are successively supplied to the piezoelectric vibrator unit 36, thereby recording a large dot.

In the first high-resolution recording mode, the decoder section 56 (translator) handles the jetting data (10) as control information to be used for recording only the preceding unit pixel, thus producing the pulse select information (110). The jetting data (01) are handled as control information to be used for recording only a subsequent unit pixel, thereby producing the pulse select information (011). The jetting data (11) are handled as control information to be used for successively recording the preceding and subsequent unit pixels, thereby producing the pulse select information (111). On the basis of contents of the pulse select information, the switch section 59 supplies a drive pulse to the piezoelectric vibrator unit 36 over the periods T1 through T3 when the pulse select information assumes (1). Consequently, on the basis of the jetting data (10), only the first drive pulse DP1 is supplied to the piezoelectric vibrator unit 36, and the preceding unit pixel is recorded in a recording area corresponding to one print cycle TA. On the basis of the jetting data (01), only the third drive pulse DP3 is supplied to the piezoelectric vibrator unit 36, thereby recording a subsequent unit pixel. Similarly, on the basis of the jetting data (11), the first drive pulse DP1 through the third drive pulse DP3 are successively supplied to the piezoelectric vibrator unit 36, whereby the preceding and subsequent unit pixels are successively recorded.

As mentioned above, in the second high-resolution mode according to the present embodiment, even if the number of ink droplets corresponding to a basic unit pixel cannot be divided in half, the number of ink droplets constituting fine unit pixels in high-resolution modes can be made uniform without involvement of a change in the drive signal to be used in the basic mode. Consequently, an identical drive signal can be used between a plurality of recording modes. Moreover, the same scanning speed of the recording head 4 can be achieved in the basic mode as well as in the high-resolution mode. As a result, control can be facilitated.

Figure 9:
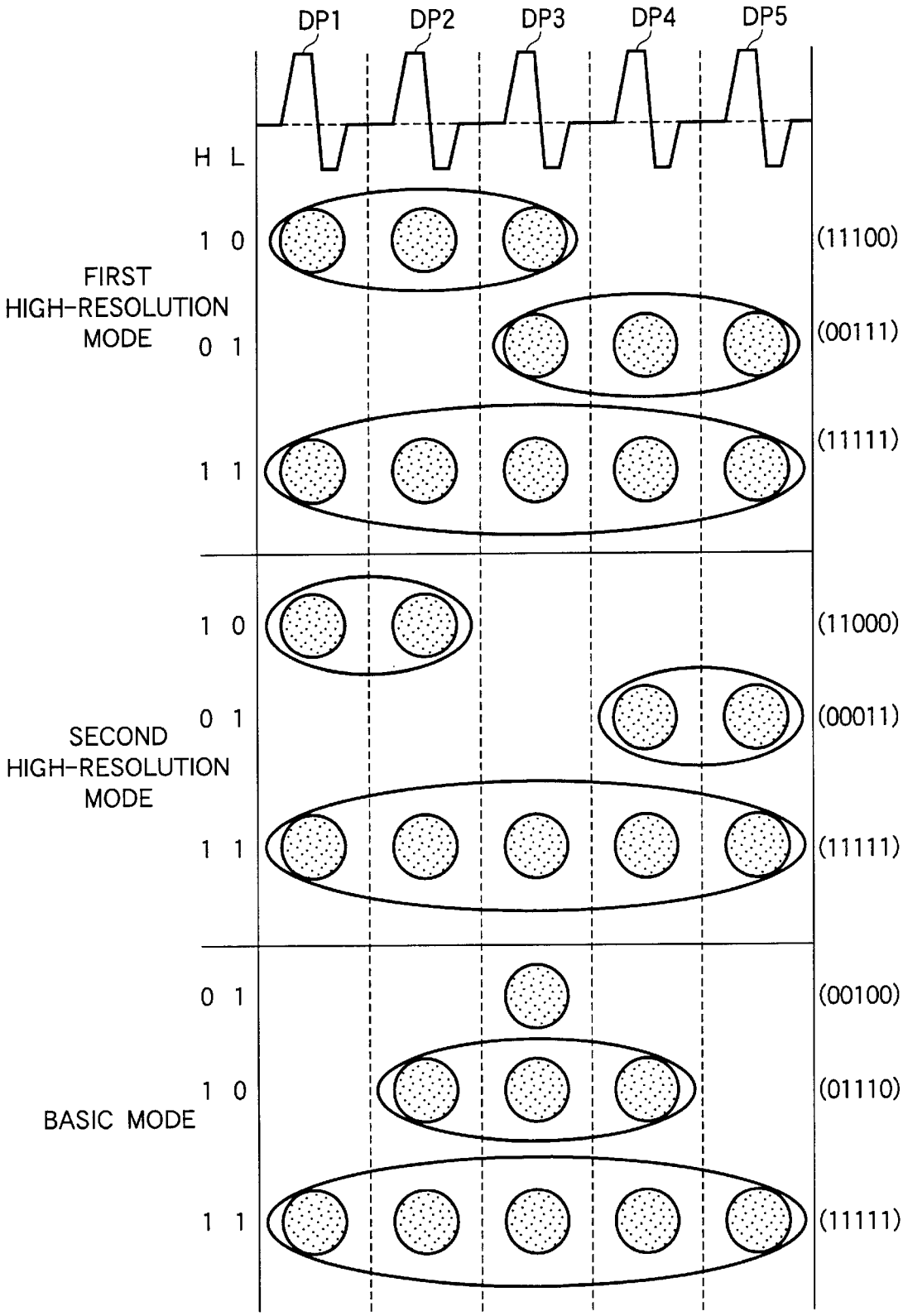
FIG. 9 is an illustration for describing recording control operation according to a third embodiment of the present invention.

In the second embodiment, a basic unit pixel in the basic mode is constituted of three ink droplets. More specifically, the first drive pulse DP1 through the third drive pulse DP3 are included in a single print cycle TA. However, the present invention is not limited to the configuration described in connection with the present embodiment. For instance, the basic unit pixel may be constituted of three or more ink droplets. Turning to FIG. 9, a third embodiment pertaining to a printer in which the basic unit pixel is constituted of three or more ink droplets will be described.

An ink jet recording apparatus according to a third embodiment of the present invention is configured in the same manner as is the recording apparatus according to the second embodiment. As shown in FIG. 9, differences between the recording apparatus according to the present embodiment and the recording apparatus according to the second embodiment are that a drive signal COM produced by the drive signal generator 48 includes five drive pulses DP1 through DP5, which are of the same waveform shape (i.e., ink droplets are substantially equal in volume to each other), are spaced at constant intervals, and that details of the waveform selection table prepared by the decoder section 56.

In the basic mode according to the third embodiment, gradation is controlled through use of a small-dot consisting of a single ink droplet, a medium-dot consisting of three ink droplets, and a large-dot consisting of five ink droplets. More specifically, in a basic mode, the control section 46 develops print data, thereby producing small-dot jetting data (gradation information 01), medium-dot jetting data (gradation information 10), and large-dot jetting data (gradation information 11). The decoder section 56 generates pulse select information corresponding to each of drive pulses, according to jetting data. More specifically, the decoder section 56 produces five bits of pulse select information, wherein the highest bit corresponds to a first drive pulse DP1, the second bit corresponds to a second drive pulse DP2, a third bit corresponds to a third drive pulse DP3, a fourth bit corresponds to a fourth drive pulse DP4, and the lowest bit corresponds to a fifth drive pulse DP5.

On the basis of details of the waveform selection table, the decoder section 56 translates the small-dot jetting data (01), thereby producing pulse select information (00100). The decoder section 56 translates the medium-dot jetting data (10), thereby producing pulse select information (01110). The decoder section 56 translates the large-dot jetting data (11), thereby producing pulse select information (11111). On the basis of the small-dot jetting data, only the third drive pulse DP3 is supplied to a corresponding piezoelectric vibrator 36. Similarly, on the basis of the medium-dot jetting data, the second drive pulse DP2 through the fourth drive pulse DP4 are successively supplied. On the basis of the large-dot jetting data, the first drive pulse DP1 through the fifth drive pulse DP5 are successively supplied. Consequently, an ink droplet is jetted one time in response to the small-dot jetting data, whereby a small dot is recorded in a recording area corresponding to a single print cycle TA. An ink droplet is jetted successively three times in response to the medium-dot jetting data, whereby a medium dot is recorded in a recording area corresponding to a single print cycle TA. An ink droplet is successively jetted five times in response to the large-dot jetting data, whereby a medium dot is recorded in a recording area corresponding to a single print cycle TA.

In the first high-resolution mode, drive pulses arising in one print cycle are divided into a plurality of pulse groups, the groups being equal in number with pulses, such that the last drive pulse in a plurality of drive pulses for a fine unit pixel to be recorded first is also included in a fine unit pixel to be recorded subsequently. The first drive pulse DP1 through the third drive pulse DP3 constitute a pulse group for recording a preceding fine unit pixel, and the third drive pulse DP3 through the fifth drive pulse DP5 constitute a pulse group for recording a subsequent fine unit pixel.

In the first high-resolution mode, in a case where only a preceding unit pixel in one print cycle TA is recorded, the control section 46 produces jetting data (10). In a case where only a subsequent unit pixel in the print cycle TA is recorded, the control section 46 produces jetting data (01). In a case where forward and subsequent unit pixels in the print cycle TA are recorded, the control section 46 produces jetting data (11). On the basis of details of the waveform selection table, the decoder section 56 translates the jetting data, thereby producing five bits of pulse select information.

Specifically, the decoder section 56 translates the jetting data (10) to be used for recording only the preceding fine unit pixel, thereby producing pulse select information (11100). Similarly, the decoder section 56 translates the jetting data (01) to be used for recording only the subsequent fine unit pixel, thereby producing pulse select information (00111). The decoder section 56 translates the jetting data (11) to be used for recording the forward and subsequent fine unit pixels, thereby producing pulse select information (11111). On the basis of the jetting data (10), the first drive pulse DP1 through the third drive pulse DP3 are successively supplied to a corresponding piezoelectric vibrator 36. Similarly, on the basis of the jetting data (01). The third drive pulse DP3 through the fifth drive pulse DP5 are successively supplied to a corresponding piezoelectric vibrator 36. On the basis of the jetting data (11), the first drive pulse DP1 through the fifth drive pulse DP5 are successively supplied to a corresponding piezoelectric vibrator 36. In other words, when preceding and subsequent unit pixels are successively recorded, the third drive pulse DP3 is used commonly.

Consequently, on the basis of the jetting data (10), a unit pixel is recorded through use of three ink droplets in the recording area corresponding to the first-half portion of the single print cycle TA. Similarly, on the basis of the jetting data (01), a unit pixel is recorded through use of three ink droplets in the recording area corresponding to the latter-half portion of the single print cycle TA. On the basis of the jetting data (11), a unit pixel is recorded, through use of five ink droplets in total, in the entire recording area corresponding to the single print cycle TA.

In the second high-resolution mode, drive pulses arising in one print cycle are divided into a plurality of pulse groups, which groups correspond to a fine unit pixel and are equal in number of pulses, such that at least one drive pulse is interposed between the plurality of pulse groups. In other words, a pulse group to be used for recording a preceding fine unit pixel is constituted of the first drive pulse DP1 and the second drive pulse DP2. A pulse group to be used for recording a subsequent fine unit pixel is constituted of the fourth drive pulse DP4 and the fifth drive pulse DP5. Accordingly, the third drive pulse DP3 is interposed between the preceding pulse group and the subsequent pulse group.

In the second high-resolution mode, in a case where only a preceding unit pixel in one print cycle TA is recorded, the control section 46 produces the jetting data (10). In a case where only a subsequent unit pixel in one print cycle TA is recorded, the control section 46 produces the jetting data (11). The decoder section 56 translates the jetting data (10), thereby producing pulse select information (11000). Similarly, the decoder section 56 translates the jetting data (01), thereby producing pulse select information (00011). The decoder section 56 translates the jetting data (11), thereby producing pulse select information (11111).

On the basis of the jetting data (10), the first drive pulse DP1 and the second drive pulse DP2 are successively supplied to a corresponding piezoelectric vibrator 36. Similarly, on the basis of the jetting data (01), the fourth drive pulse DP4 and the fifth drive pulse DP5 are successively supplied to a corresponding piezoelectric vibrator 36. On the basis of the jetting data (11), the first drive pulse DP1 through the fifth drive pulse DP5 are successively supplied to a corresponding piezoelectric vibrator 36. More specifically, when the preceding and subsequent pixels are successively recorded, the third drive pulse DP3 interposed between the pulse groups is supplied to the piezoelectric vibrator unit 36.

Consequently, on the basis of the jetting data (10), a unit pixel is recorded through use of two ink droplets within a recording area corresponding to the first-half portion of one print cycle TA. Similarly, on the basis of the jetting data (01), a unit pixel is recorded through use of two ink droplets within a recording area corresponding to the latter-half portion of one print cycle TA. A fine unit pixel is recorded through use of five ink droplets in total within the entire recording area corresponding to one print cycle TA.

As mentioned above, even in the embodiment, if the number of ink droplets corresponding to a basic unit pixel cannot be divided in half, a uniform unit pixel can be formed in each of the high-resolution modes without involvement of a change in the drive signal used in the basic mode. Consequently, an identical drive signal can be used between a plurality of recording modes. Moreover, the same scanning speed of the recording head 4 can be achieved in the basic mode as well as in the high-resolution mode. As a result, control can be facilitated.

In the above embodiments, although resolution in the main scanning direction in a high-resolution mode is set to twice, the resolution may be set to a much higher level of resolution.

Figure 10:
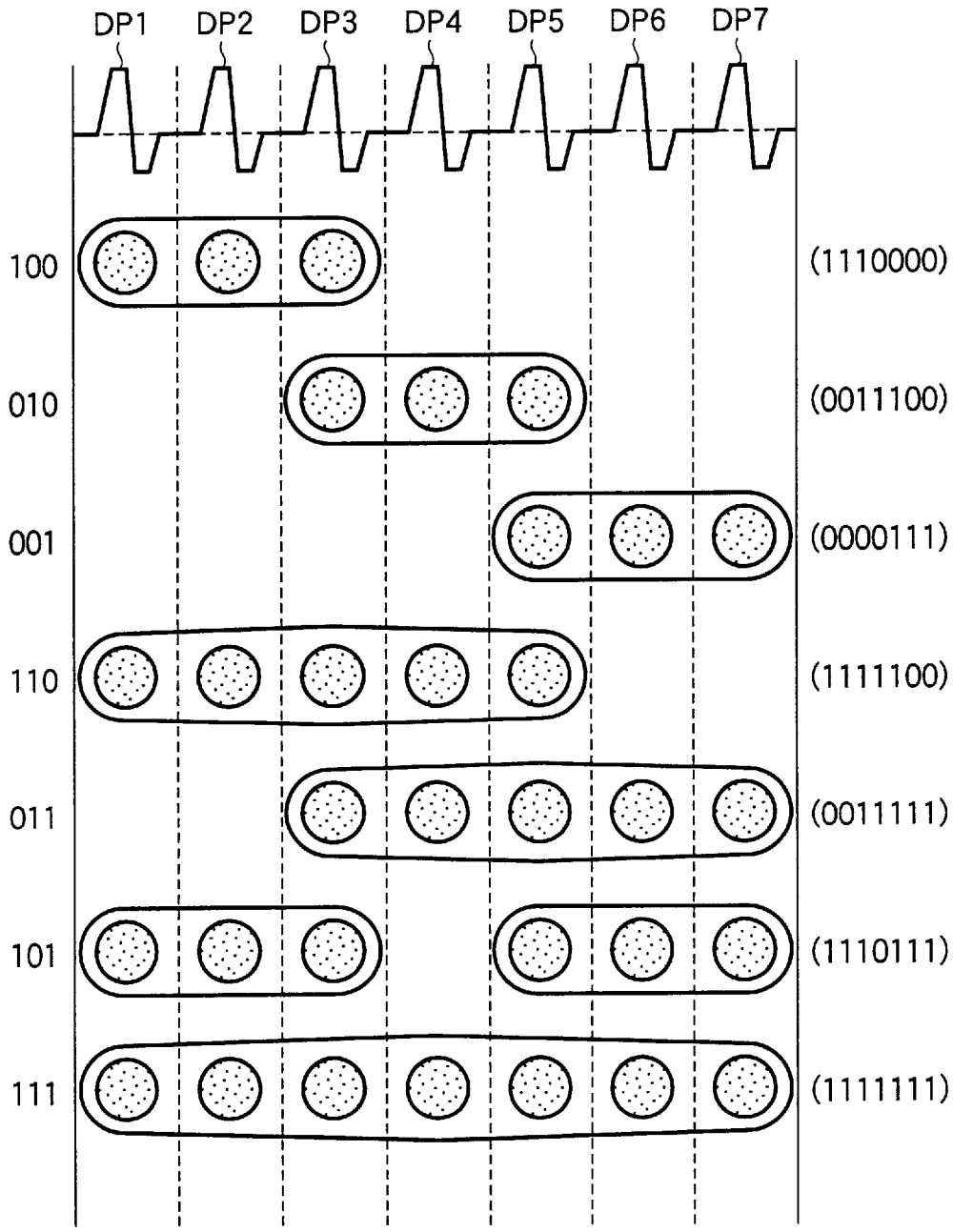
FIG. 10 is an illustration for describing recording control operation according to a fourth embodiment of the present invention.

FIG. 10 shows a fourth embodiment, in which resolution in the main scanning direction in the first high-resolution mode is set to three times that in the basic mode. In the present embodiment, the drive signal generator 48 produces a drive signal consisting of seven drive pulses: that is, the first drive pulse DP1 through the seventh drive pulse DP7, wherein the drive pulses are spaced at constant intervals. The jetting data consist of three bits.

In the high-resolution mode, drive pulses arising in one print cycle are divided into a plurality of pulse groups, the groups being equal in number with pulses, such that the last drive pulse in a plurality of drive pulses for a fine unit pixel to be recorded previously is also included in a fine unit pixel to be recorded subsequently. The first drive pulse DP1 through the third drive pulse DP3 constitute a first pulse group for recording a preceding fine unit pixel, and the third drive pulse DP3 through the fifth drive pulse DP5 constitute a second pulse group for recording a center fine unit pixel. The fifth drive pulse DP5 through the seventh drive pulse DP7 constitute a third pulse group for recording a subsequent fine unit pixel. The third drive pulse DP3 is included in both the first pulse group serving as a preceding pulse group and the second pulse group serving as a subsequent pulse group. Similarly, the fifth drive pulse DP5 is included in both the second pulse group serving as a preceding pulse group and the third pulse group serving as a subsequent pulse group.

In the first high-resolution mode, in a case where only a preceding unit pixel in one print cycle TA is recorded, the control section 46 produces jetting data (100). In a case where only a center unit pixel in the print cycle TA is recorded, the control section 46 produces jetting data (010). In a case where only a subsequent unit pixel in the print cycle TA is recorded, the control section 46 produces jetting data (001). In a case where the forward and center unit pixels in the print cycle TA are recorded, the control section 46 produces jetting data (110). In a case where the center and subsequent unit pixels in the print cycle TA are recorded, the control section 46 produces jetting data (011). In a case where the forward and subsequent unit pixels in the print cycle TA are recorded, the control section 46 produces jetting data (101). In a case where the center and subsequent unit pixels in the print cycle TA are recorded, the control section 46 produces jetting data (111).

On the basis of the jetting data, the decoder section 56 produces seven bits of pulse select information. Specifically, the decoder section 56 translates the jetting data (100), thereby producing pulse select information (1110000). The decoder section 56 translates the jetting data (010), thereby producing pulse select information (0011100). The decoder section 56 translates the jetting data (001), thereby producing pulse select information (0000111). The decoder section 56 translates the jetting data (110), thereby producing pulse select information (1111100). The decoder section 56 translates the jetting data (011), thereby producing pulse select information (0011111). The decoder section 56 translates the jetting data (111), thereby producing pulse select information (1111111).

On the basis of the jetting data, predetermined drive pulses DP1 through DP7 are successively supplied to a corresponding piezoelectric vibrator 36. For example, in response to the jetting data (100), the first drive pulse DP1 through the third drive pulse DP3 are successively supplied to a corresponding piezoelectric vibrator 36. In response to the jetting data (110), the first drive pulse DP1 through the fifth drive pulse DP5 are successively supplied to a corresponding piezoelectric vibrator 36. In response to the jetting data (101), the first drive pulse DP1 through the third drive pulse DP3 and the fifth drive pulse DP5 through the seventh drive pulse DP7 are successively supplied to a corresponding piezoelectric vibrator 36.

Consequently, a fine unit pixel corresponding to jetting data is recorded in a recording area. For example, on the basis of the jetting data (100), a fine unit pixel is recorded through use of three ink droplets within a recording area corresponding to a forward portion of one print cycle TA. Similarly, on the basis of the jetting data (110), a fine unit pixel is recorded through use of five ink droplets within a recording area corresponding to the range from the forward portion to the center portion of one print cycle TA. On the basis of the jetting data (101), two fine unit pixels are recorded through use of three ink droplets within a recording area corresponding to the forward portion and the rear portion of one print cycle TA.

Even in the present embodiment, even if the number of ink droplets constituting the unit pixel in the basic mode cannot be divided equally, the number of ink droplets constituting fine unit pixels in high-resolution modes can be made uniform without involvement of a change in the drive signal to be used in the basic mode. Consequently, an identical drive signal can be used between a plurality of recording modes. Moreover, the same scanning speed of the recording head 4 can be achieved in the basic mode as well as in the high-resolution mode.

To perform a basic mode recording, there may be configured that one of the jetting data (100), (010) and (001) is selected to record a small dot, that one of the jetting data (110) and (011) is selected to record a medium dot, and that the jetting data (111) is selected to record a large dot.

The above embodiments can be subjected to various addition or modifications within the scope of the invention. For example, the waveform selection table may be configured so as to be rewritable. By means of such a configuration, a combination between jetting data and a drive pulse to be selected can be set comparatively freely, and hence printers of different specifications, such as the printer described in connection with the first embodiment and the printer described in connection with the second embodiment, can be manufactured easily.

Further, the start timing of the print cycle TA may be obtained by means of a head scanning mechanism. This may prevent occurrence of positional displacements in a position where a pixel is to be produced, which would otherwise be caused by a variation in head scanning speed (i.e., the scanning speed of the carriage 5). More specifically, a linear scale is provided in the housing 6 of the printer 1 so as to extend in parallel with the guide member 7 of the carriage 5. A linear encoder is mounted on the carriage 5 so as to be able to read the linear scale. By means of such a configuration, the scanning speed of the recording head 4 (i.e., the carriage 5) can be determined on the basis of the signal detected by the linear encoder. The start timing of the print cycle TA can be determined in accordance with the thus-determined scanning speed.

A pressure generating element used for varying the volume of the pressure chamber 24 is not limited to the piezoelectric vibrator unit 36. For instance, a magnetostrictive element may be used as a pressure generating element so as to cause the pressure chamber 24 to expand and constrict, thereby inducing pressure fluctuations. Alternatively, a heat-generation element may be used as a pressure generating element for inducing pressure fluctuations in the pressure chamber 24 by means of air bubbles.

As mentioned above, a printer controller 41 can be constituted of a computer system. However, a program to be used for causing a computer system to implement constituent elements and a computer-readable recording medium 301 having recorded thereon the program fall within the scope of the present invention.

In a case where the constituent elements are embodied by a program operating on a computer system, such as an operating system, a program including commands for controlling the program, such as an operating system, and a recording medium 302 having recorded thereon the program fall within the scope of the present invention.

Here, the recording medium is not limited to any particular medium. For example, the recording medium includes a medium conceivable as a single unit, such as a floppy disk or an optical disk, and a network for transmitting various signals.

What is claimed is:

1. An ink jet recording apparatus comprising:

a recording head provided with a pressure generating element;

a scanning mechanism for moving the recording head in a main scanning direction;

a drive signal generator for generating a drive signal including a plurality of drive pulses, on every unit print cycle;

a drive pulse supplier for selectively supplying at least one of the drive pulses to the pressure generating element in accordance with print data, to drive the pressure generating element; and a high-resolution recording mode for recording through use of a fine unit pixel, a plurality of fine unit pixels being arranged in the main scanning direction within a unit recording area corresponding to the unit print cycle, wherein the drive pulse supplier divides the drive pulses in the drive signal into a plurality of groups each including a same number of the drive pulses such that the last drive pulse included in a group used for a fine unit pixel to be recorded previously is also included in a group used for a fine unit pixel to be recorded subsequently, and supplies the drive pulses included in at least one of the groups to the pressure generating element.

2. The ink jet recording apparatus as set forth in claim 1, further comprising:

a basic recording mode for recording through use of a basic unit pixel which is associated with the unit recording area; and a mode selector for selecting one of the basic recording mode and the high-resolution recording mode.

3. The ink jet recording apparatus as set forth in claim 2, wherein the print data includes gradation information; and wherein the drive pulse supplier changes the number of drive pulse to be supplied to the pressure generating element in accordance with the gradation information under the basic recording mode.

4. The ink jet recording apparatus as set forth in claim 2, wherein the drive pulse supplier is provided with waveform select tables associated with the respective recording modes; and wherein each of the waveform select table defines a correspondence between the jetting data and the selected drive pulse in the associated recording mode.

5. The ink jet recording apparatus as set forth in claim 4, wherein the waveform select table is rewritable.

6. The ink jet recording apparatus as set forth in claim 1, wherein the plural drive pulses are of an identical profile.

7. The ink jet recording apparatus as set forth in claim 1, wherein the plural drive pulses are spaced at constant intervals within the unit print cycle.

8. The ink jet recording apparatus as set forth in claim 1, wherein the drive pulse supplier is provided with a waveform select table in which a correspondence between the jetting data and the selected drive pulse.

9. The ink jet recording apparatus as set forth in claim 8, wherein the waveform select table is rewritable.

10. The ink jet recording apparatus as set forth in claim 1, wherein an initial trigger for starting the unit print cycle is derived from the scanning mechanism.

11. The ink jet recording apparatus as set forth in claim 1, wherein an initial trigger for starting the unit print cycle is derived from the scanning mechanism.

12. An ink jet recording apparatus comprising:

a recording head provided with a pressure generating element;

a scanning mechanism for moving the recording head in a main scanning direction;

a drive signal generator for generating a drive signal including a plurality of drive pulses, on every unit print cycle;

a drive pulse supplier for selectively supplying at least one of the drive pulses to the pressure generating element in accordance with print data, to drive the pressure generating element;

a high resolution recording mode for recording through use of a fine unit pixel, a plurality of fine unit pixels being arranged in the main scanning direction within a unit recording area corresponding to the unit print cycle;

wherein the drive pulse supplier divides the drive pulses in the drive signal into a plurality of groups each including a same number of the drive pulses such that at least one drive pulse is interposed between a group used for a fine unit pixel to be recorded previously and a group used for a fine unit pixel to be recorded subsequently, and supplies the drive pulses included in at least one of the groups to the pressure generating element; and wherein the drive pulse supplier also supplies the interposed drive pulse to the pressure generating element when both of the groups are used to record the previous fine unit pixel and the subsequent fine pixel.

13. The ink jet recording apparatus as set forth in claim 12, further comprising:

a basic recording mode for recording through use of a basic unit pixel which is associated with the unit recording area; and a mode selector for selecting one of the basic recording mode and the high-recording mode.

14. The ink jet recording apparatus as set forth in claim 13, wherein the print data includes gradation information; and wherein the drive pulse supplier changes the number of drive pulse to be supplied to the pressure generating element in accordance with the gradation information under the basic recording mode.

15. The ink jet recording apparatus as set forth in claim 13, wherein the drive pulse supplier is provided with waveform select tables associated with the respective recording modes; and wherein each of the waveform select table defines a correspondence between the jetting data and the selected drive pulse in the associated recording mode.

16. The ink jet recording apparatus as set forth in claim 15, wherein the waveform select table is rewritable.

17. The ink jet recording apparatus as set forth in claim 12, wherein the plural drive pulses are of an identical profile.

18. The ink jet recording apparatus as set forth in claim 12, wherein the plural drive pulses are spaced at constant intervals within the unit print cycle.

19. The ink jet recording apparatus as set forth in claim 12, wherein the drive pulse supplier is provided with a waveform select table in which a correspondence between the jetting data and the selected drive pulse.

20. The ink jet recording apparatus as set forth in claim 19, wherein the waveform select table is rewritable.

21. The ink jet recording apparatus as set forth in claim 12, wherein an initial trigger for starting the unit print cycle is derived from the scanning mechanism.

22. An ink jet recording apparatus comprising:

a recording head provided with a pressure generating element;

a scanning mechanism for moving the recording head in a main scanning direction;

a drive signal generator for generating a drive signal including a plurality of drive pulses, on every unit print cycle;

a drive pulse supplier for selectively supplying at least one of the drive pulses to the pressure generating element in accordance with print data, to drive the pressure generating element;

a high resolution recording mode for recording through use of a fine unit pixel, a plurality of fine unit pixels being arranged in the main scanning direction within a unit recording area corresponding to the unit print cycle; the high-resolution recording mode including:

a first high-resolution recording mode in which the drive pulse supplier divides the drive pulses in the drive pulse signal into a plurality of groups each including a same number of the drive pulses such that the last drive pulse included in the group used for a fine unit pixel to be recorded previously is also included in a group used for a fine unit pixel to be recorded subsequently; and supplies the drive pulses included in at least one of the groups to the pressure generating element; and a second high-resolution recording mode in which the drive pulse supplier divides the drive pulses in the drive signal into a plurality of groups each including a same number of the drive pulses such that at least one drive pulse is interposed between a group used for a fine unit pixel to be recorded previously and a group used for a fine unit pixel to be recorded subsequently, and supplies the drive pulses included in at least one of the groups to the pressure generating element, and the drive pulse supplier also supplies the interposed drive pulse to the pressure generating element when both of the groups are used to record the previous fine unit pixel and the subsequent fine unit pixel; and mode selector for selecting one of a plurality of recording modes including the first high-resolution recording mode and the second high-resolution recording mode.

23. The ink jet recording apparatus as set forth in claim 22, further comprising a basic recording mode for recording through use of a basic unit pixel which is associated with the unit recording area.

24. The ink jet recording apparatus as set forth in claim 23, wherein the print data includes gradation information; and wherein the drive pulse supplier changes the number of drive pulse to be supplied to the pressure generating element in accordance with the gradation information under the basic recording mode.

25. The ink jet recording apparatus as set forth in claim 22, wherein the plural drive pulses are of an identical profile.

26. The ink jet recording apparatus as set forth in claim 22, wherein the plural drive pulses are spaced at constant intervals within the unit print cycle.

27. The ink jet recording apparatus as set forth in claim 22, wherein the drive pulse supplier is provided with a waveform select table in which a correspondence between the jetting data and the selected drive pulse.

28. The ink jet recording apparatus as set forth in claim 27, wherein the waveform select table includes a plurality of tables associated with the respective recording modes; and wherein each of the waveform select table defines a correspondence between the jetting data and the selected drive pulse in the associated recording mode.

29. The ink jet recording apparatus as set forth in claim 27, wherein the waveform select table is rewritable.

30. An ink jet recording apparatus comprising:

a recording head provided with a pressure generating element;

a scanning mechanism for moving the recording head in a main scanning direction;

a data developer for developing print data into jetting data; wherein the data developer develops print data into jetting data such that bits therein indicate the size of a dot to be recorded in a unit recording area, when a mode selector selects a basic recording mode in accordance with the print data, a drive signal generator for generating a drive signal including a plurality of drive pulses, on every unit print cycle, wherein the plural drive pulses are of an identical profile and are spaced at constant intervals within the unit print cycle;

a translator for translating the jetting data into pulse select information associated with the respective drive pulses; wherein the translator is provided with waveform select tables associated with the respective recording modes, said waveform select tables being rewritable, and, wherein each of the waveform select table defines a correspondence between the jetting data and the pulse select information in the associated recording mode; and wherein the translator translates the jetting data into the pulse select information with reference to the waveform select table of the recording mode selected by the mode selector, a drive pulse supplier for selectively supplying at least one of the drive pulses to the pressure generating element in accordance with the pulse select information to drive the pressure generating element;

a basic recording mode for recording a dot having a size which is selected from one of a plurality of sizes, in a basic unit pixel which is associated with a unit recording area corresponding to the unit print cycle;

a high-resolution recording mode for recording a dot in a fine unit pixel, a plurality of fine unit pixels being arranged within the unit recording area in the main scanning direction; and a mode selector for selecting one of plural recording modes including the basic recording mode and the high-resolution recording mode, wherein the data developer develops the print data into the jetting data so as to indicate the size of the dot to be recorded in the basic unit pixel, when the mode selector selects the basic recording mode;

wherein the data developer develops the print data into the jetting data such that each bit therein indicates whether the recording is conducted or not in each associated fine unit pixel, when the mode selector selects the high-resolution recording mode, wherein both of the recording on the basic unit pixel and the recording on the fine unit pixel are performed by a single movement of the recording head in the main scanning direction at a constant scanning speed of the recording head wherein an initial trigger for starting the unit print cycle is derived from the scanning mechanism.

31. An ink jet recording apparatus comprising:

a recording head provided with a pressure generating element;

a scanning mechanism for moving the recording head in a main scanning direction;

a data developer for developing print data into jetting data;

a drive signal generator for generating a drive signal including a plurality of drive pulses, on every unit print cycle;

a translator for translating the jetting data into pulse select information associated with the respective drive pulses;

a drive pulse supplier for selectively supplying at least one of the drive pulses to the pressure generating element in accordance with the pulse select information to drive the pressure generating element;

a basic recording mode for recording through use of a basic unit pixel which is associated with a unit recording area corresponding to the unit print cycle;

a high-resolution recording mode for recording through use of a fine unit pixel, a plurality of fine unit pixels being arranged within the unit recording area in the main scanning direction; and a mode selector for selecting one of plural recording modes including the basic recording mode and the high-resolution recording mode, wherein both of the recording on the basic unit pixel and the recording on the fine unit pixel are performed at a constant speed of the recording head in the main scanning direction, wherein the data developer develops the print data into jetting data so as to indicate a number of ink ejection performed in the basic unit pixel when the mode selector selects the basic recording mode; and wherein the data developer develops the print data into the jetting data such that each bit therein indicates whether the recording is conducted or not in each associated fine unit pixel, when the mode selector selects the high-resolution recording mode.

* * * * *